US009416473B2

(12) United States Patent
Magara et al.

(10) Patent No.: US 9,416,473 B2
(45) Date of Patent: Aug. 16, 2016

(54) UPPER FEED DEVICE AND SEWING MACHINE

(71) Applicants: Midori Magara, Nagoya (JP); Harumi Kato, Nagoya (JP)

(72) Inventors: Midori Magara, Nagoya (JP); Harumi Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 656 days.

(21) Appl. No.: 13/777,598

(22) Filed: Feb. 26, 2013

(65) Prior Publication Data

US 2013/0247805 A1 Sep. 26, 2013

(30) Foreign Application Priority Data

Mar. 23, 2012 (JP) ..... 2012-067289

(51) Int. Cl.
*D05B 19/12* (2006.01)
*D05B 27/04* (2006.01)
*D05B 69/10* (2006.01)

(52) U.S. Cl.
CPC ..... *D05B 19/12* (2013.01); *D05B 27/04* (2013.01); *D05B 69/10* (2013.01)

(58) Field of Classification Search
CPC ..... D05B 27/04; D05B 27/00; D05B 29/10; D05B 19/12
USPC ..... 112/304, 317, 318, 320, 322, 470.06
See application file for complete search history.

(56) References Cited

U.S. PATENT DOCUMENTS

| | | | | | |
|---|---|---|---|---|---|
| 1,715,119 | A | | 5/1929 | Clarkson | |
| 1,809,148 | A | * | 6/1931 | Schrago | 112/304 |
| 3,003,443 | A | * | 10/1961 | Condran | 112/322 |
| 3,800,719 | A | | 4/1974 | Rockerath | |
| 3,948,195 | A | * | 4/1976 | Chudner | 112/322 |
| 4,072,115 | A | | 2/1978 | Marforio | |
| 4,152,995 | A | * | 5/1979 | Klundt | 112/318 |
| 4,187,795 | A | | 2/1980 | Norton | |
| 4,295,435 | A | * | 10/1981 | Uemura et al. | 112/322 |
| 4,417,535 | A | * | 11/1983 | Hannemann | 112/304 |
| 4,462,530 | A | * | 7/1984 | Block et al. | 226/156 |
| 4,632,046 | A | | 12/1986 | Barrett et al. | |
| 4,719,864 | A | | 1/1988 | Barrett et al. | |
| 4,836,119 | A | | 6/1989 | Siraco et al. | |
| 4,928,611 | A | | 5/1990 | Ogawa | |

(Continued)

FOREIGN PATENT DOCUMENTS

| | | | |
|---|---|---|---|
| JP | S52-74449 | A | 6/1977 |
| JP | S55-16630 | A | 2/1980 |

(Continued)

OTHER PUBLICATIONS

U.S. Appl. No. 14/020,040, filed Sep. 6, 2013 in the name of Ihira et al.

(Continued)

*Primary Examiner* — Nathan Durham
(74) *Attorney, Agent, or Firm* — Oliff PLC

(57) ABSTRACT

An upper feed device includes a mounting portion, a feed mechanism, a drive portion, and a connecting portion. The mounting portion is configured to mount the upper feed device to a presser bar of a sewing machine. The feed mechanism is configured to feed a work cloth. The drive portion is configured to drive the feed mechanism. The connecting portion is configured to electrically connect the drive portion to a control portion of the sewing machine.

19 Claims, 21 Drawing Sheets

(56) References Cited

U.S. PATENT DOCUMENTS

| | | | | |
|---|---|---|---|---|
| 5,331,910 | A | 7/1994 | Mukai et al. | |
| 5,410,975 | A | 5/1995 | Dudek et al. | |
| 5,579,708 | A | 12/1996 | Kambara et al. | |
| 6,123,039 | A | 9/2000 | Niino | |
| 6,415,727 | B1 | 7/2002 | Burgess et al. | |
| 6,973,886 | B2 * | 12/2005 | Marcangelo | 112/2.1 |
| 8,904,946 | B2 | 12/2014 | Ihira et al. | |

FOREIGN PATENT DOCUMENTS

| | | | |
|---|---|---|---|
| JP | S55-84194 | A | 6/1980 |
| JP | A-59-149178 | | 8/1984 |
| JP | A-59-164091 | | 9/1984 |
| JP | U-61-54771 | | 4/1986 |
| JP | A-62-129092 | | 6/1987 |
| JP | H01-305992 | A | 12/1989 |
| JP | A-04-348792 | | 12/1992 |
| JP | A-05-269282 | | 10/1993 |
| JP | 2000-153088 | A | 6/2000 |
| JP | 2001-321586 | A | 11/2001 |
| JP | A-2004-223005 | | 8/2004 |
| JP | 2009-089833 | A | 4/2009 |

OTHER PUBLICATIONS

U.S. Appl. No. 13/917,202, filed Jun. 13, 2013 in the name of Harumi Kato et al.

Jun. 19, 2015 Office Action issued in U.S. Appl. No. 13/917,202.

Jul. 18, 2014 Office Action issued in U.S. Appl. No. 14/020,040.

Aug. 5, 2014 Miscellaneous Communication issued in U.S. Appl. No. 14/020,040.

Nov. 10, 2015 Office Action issued in Japanese Patent Application No. 2012-067289.

* cited by examiner

UPPER FEED DEVICE AND SEWING MACHINE

CROSS-REFERENCE TO RELATED APPLICATION

This application claims priority to Japanese Patent Application No. 2012-067289 filed Mar. 23, 2012, the content of which is hereby incorporated herein by reference.

BACKGROUND

The present disclosure relates to an upper feed device that is provided above a needle plate of a sewing machine and is capable of feeding a work cloth and to a sewing machine that includes the upper feed device.

An upper feed device for a sewing machine is known that is disposed higher than a bed of the sewing machine and that may operate in conjunction with a feed dog to feed a work cloth. For example, a known work cloth guide device may be secured by a screw to the rear side of a head. The head is provided on a left portion of an arm. A drive transmission mechanism is provided in a right rear portion of the arm. A rotary movement of the drive transmission mechanism is transmitted to the work cloth guide device through a universal joint and a connecting shaft. The feeding of the work cloth may thus be carried out.

SUMMARY

The sewing machine is not control the known upper feed device.

Embodiments of the broad principles derived herein provide an upper feed device that can be controlled by a sewing machine, as well as a sewing machine that includes an upper feed device.

Embodiments provide an upper feed device that includes a mounting portion, a feed mechanism, a drive portion, and a connecting portion. The mounting portion is configured to mount the upper feed device to a presser bar of a sewing machine. The feed mechanism is configured to feed a work cloth. The drive portion is configured to drive the feed mechanism. The connecting portion is configured to electrically connect the drive portion to a control portion of the sewing machine.

Embodiments also provide a sewing machine that includes a presser bar, a control portion, and an upper feed device. The upper feed device includes a mounting portion, a feed mechanism, a drive portion, and a connecting portion. The mounting portion is configured to mount the upper feed device to the presser bar. The feed mechanism is configured to feed a work cloth. The drive portion is configured to drive the feed mechanism. The connecting portion is configured to electrically connect the drive portion to the control portion.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. A sewing machine 1 according to the present embodiment can form a stitch on a work cloth by moving the work cloth in relation to a needle that is moved up and down. The sewing machine 1 according to the present embodiment is an example of a sewing machine to which an upper feed device 4, which will be described below, can be mounted.

Figure 1:
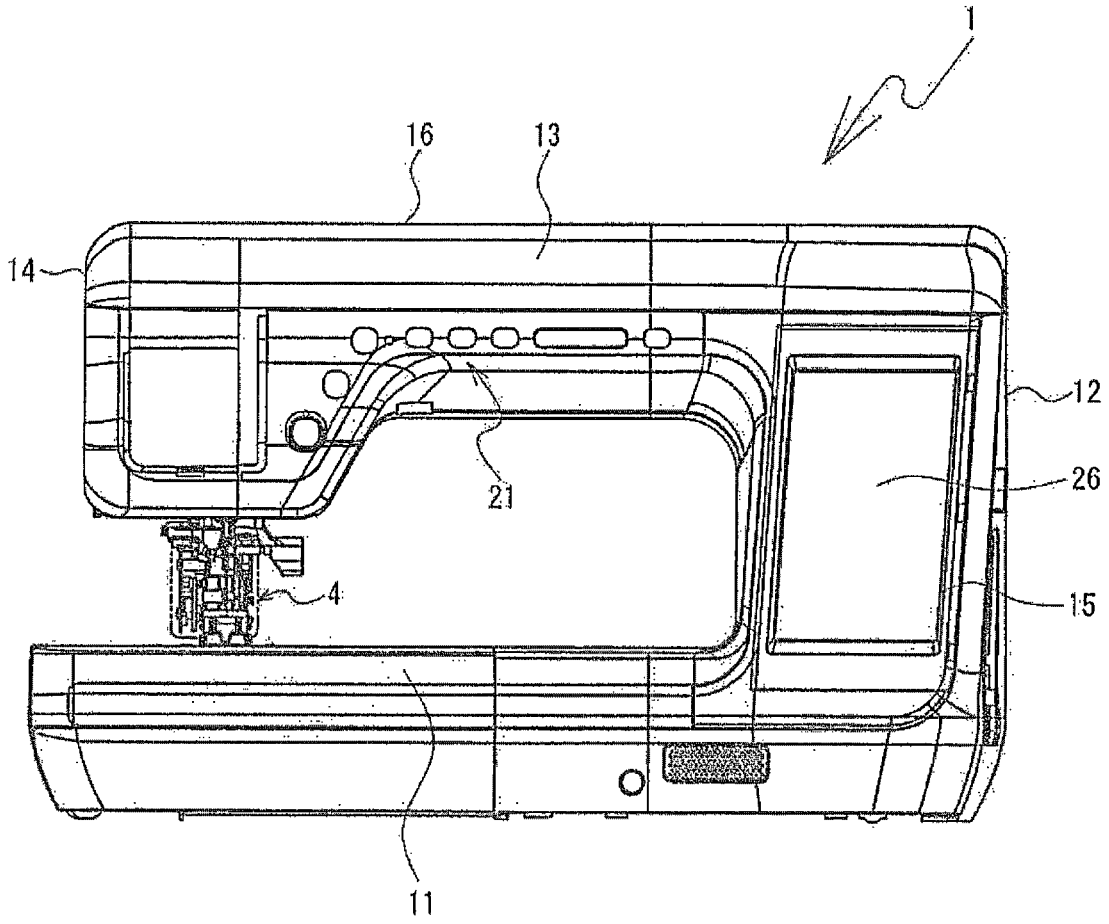
FIG. 1 is a front view of a sewing machine.
Figure 2:
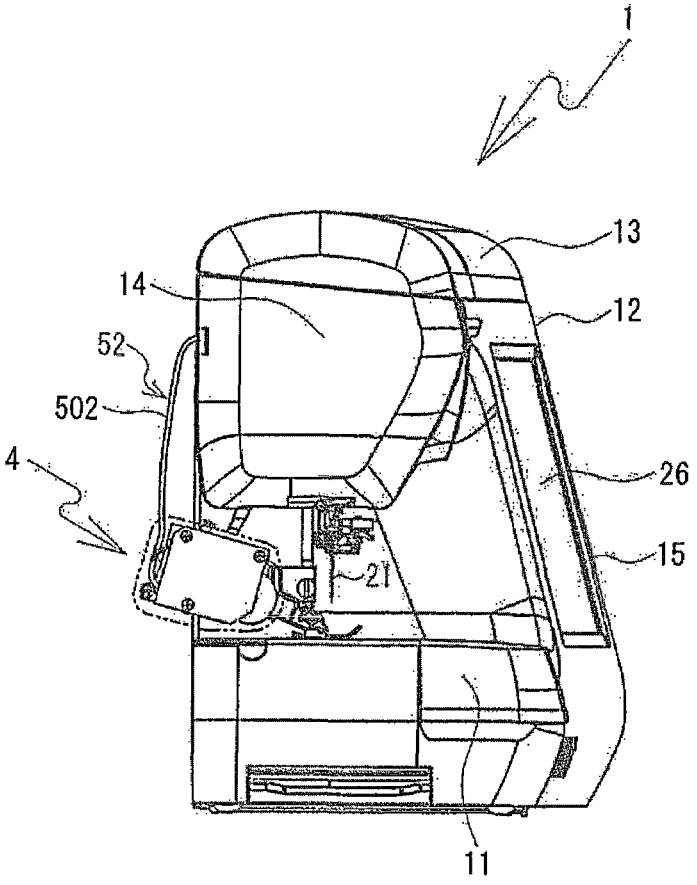
FIG. 2 is a left side view of the sewing machine.
Figure 3:
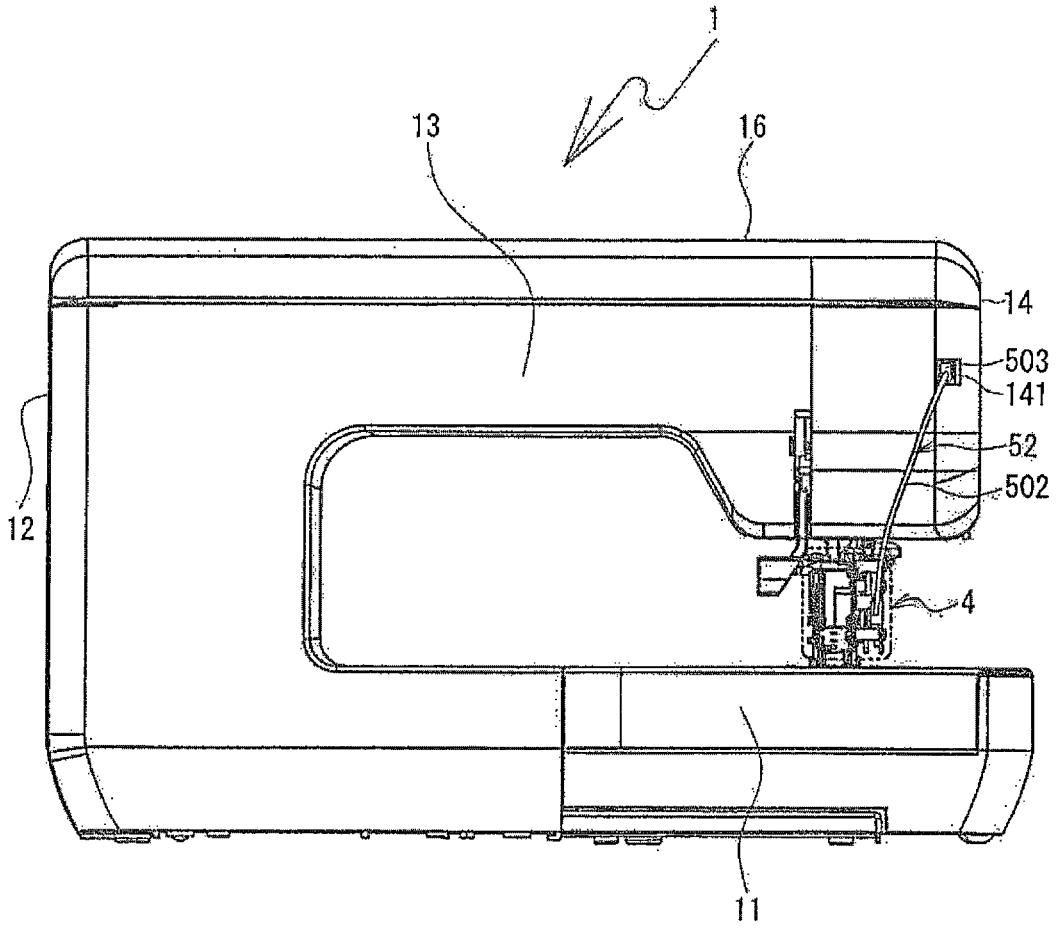
FIG. 3 is a rear view of the sewing machine.

A physical structure of the sewing machine 1 will be explained with reference to FIGS. 1 to 3. In the following explanation, the near side, the far side, the upper side, the lower side, the left side, and the right side of FIG. 1 are respectively defined as the front side, the rear side, the upper side, the lower side, the left side, and the right side of the sewing machine 1. In other words, a direction in which a pillar 12, which will be explained below, extends is the up-down direction of the sewing machine 1. A longitudinal direction of a bed 11 and an arm 13 is the left-right direction of the sewing machine 1. A surface on which a switch cluster 21 is arranged is the front surface of the sewing machine 1.

As shown in FIG. 1, the sewing machine 1 includes the bed 11, the pillar 12, the arm 13, and a head 14. The bed 11 is long in the left-right direction. The pillar 12 extends upward from the right end of the bed 11. The arm 13 extends to the left from the upper end of the pillar 12. The head 14 is provided on the left side of the arm 13. The bed 11 is provided with a needle plate 33 (refer to FIG. 5), a feed dog 34 (refer to FIG. 5), a cloth feed mechanism (not shown in the drawings), a feed adjustment motor 78 (refer to FIG. 15), and a shuttle mechanism (not shown in the drawings). The needle plate 22 is disposed on an upper surface of the bed 11. The feed dog 34 is provided under the needle plate 33. The feed dog 34 may feed, by a specified feed distance, a work cloth 100 (refer to FIG. 2) on which sewing is performed. The cloth feed mechanism may drive the feed dog 34. The feed adjustment motor 78 may adjust the feed distance. The head 14 is provided with a needle bar mechanism (not shown in the drawings), a needle bar swinging motor 80 (refer to FIG. 15), and a thread take-up mechanism (not shown in the drawings). The needle bar mechanism may move a needle bar (not shown in the drawings) in the up-down direction. A sewing needle 29 may be attached to the needle bar. The needle bar swinging motor 80 may swing the needle bar in the left-right direction.

A liquid crystal display 15 is provided on the front face of the pillar 12. The liquid crystal display 15 has a vertical rectangular shape. For example, keys that are used to execute various functions necessary to the sewing operation, various messages, and various patterns etc. may be displayed on the liquid crystal display 15.

A transparent touch panel 26 is provided in the upper surface (front surface) of the liquid crystal display 15. A user may perform an operation of pressing the touch panel 26, using a finger or a dedicated touch pen, in a position corresponding to one of the various keys or the like displayed on the liquid crystal display 15. This operation is hereinafter referred to as a "panel operation." The touch panel 26 detects the position pressed by the finger or the dedicated touch pen etc. The sewing machine 1 (more specifically, a CPU 61 to be described below) determines an item corresponding to the detected position. In this way, the sewing machine 1 recognizes the selected item. By performing the panel operation, the user can perform pattern selection and various settings etc.

The structure of the arm 13 will be explained. A cover 16 is attached to the upper portion of the arm 13 along the longitudinal direction of the arm 13. The cover 16 is supported such that the cover 16 can be opened and closed by being rotated about an axis that extends in the left-right direction at the upper rear edge of the arm 13. A thread container portion (not shown in the drawings) is provided close to the middle of the top of the arm 13 under the cover 16. The thread container portion is a recessed portion for containing a thread spool (not shown in the drawings). A spool pin is provided in the thread container portion. A thread spool may be mounted to the spool pin. The head 14 is provided with a thread guide that includes a tensioner, a thread take-up spring, a thread take-up lever, and the like, which are not shown in the drawings. An upper thread (not shown in the drawings) may be supplied from the thread spool via the thread guide to the sewing needle 29 that is attached to the needle bar.

A sewing machine motor 79 (refer to FIG. 15) is provided inside the pillar 12. The sewing machine motor 79 may rotate a drive shaft (not shown in the drawings). The drive shaft extends in the direction in which the arm 13 extends. The needle bar mechanism and the thread take-up mechanism may be driven by the rotating of the drive shaft. The switch cluster 21 is provided on the lower part of the front face of the arm 13. The switch cluster 21 includes a sewing start/stop switch, a reverse stitch switch, a needle up/down switch, and the like.

A presser bar 27 (refer to FIG. 5) is located at the rear of the needle bar. The upper feed device 4 may be mounted to the lower end of the presser bar 27. The upper feed device 4 may be positioned higher than the bed 11. The upper feed device 4 may feed the work cloth 100 by operating in coordination with the feed dog 34.

Figure 4:
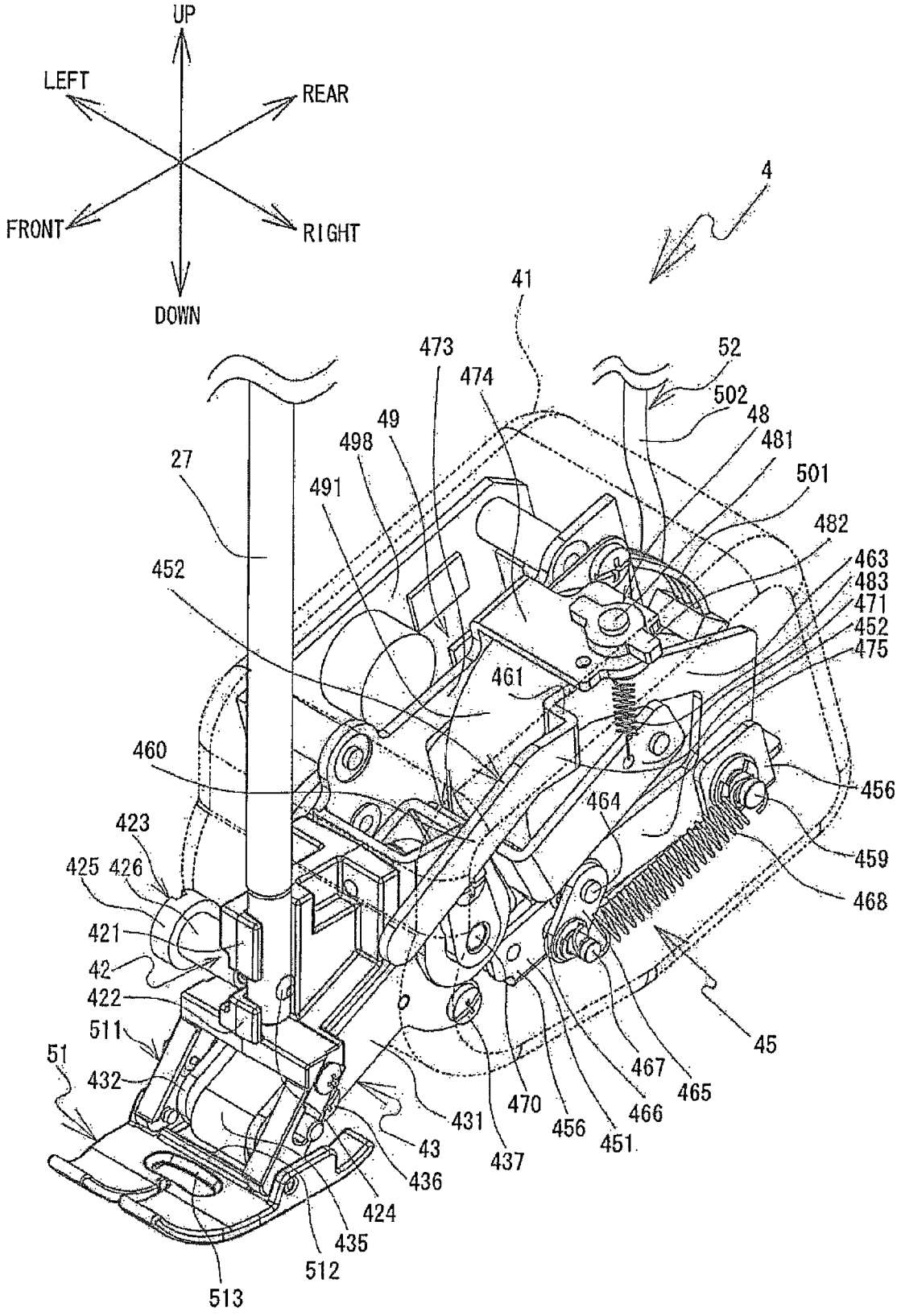
FIG. 4 is an oblique view of an upper feed device in a case where a feed mechanism is in a feed position.
Figure 5:
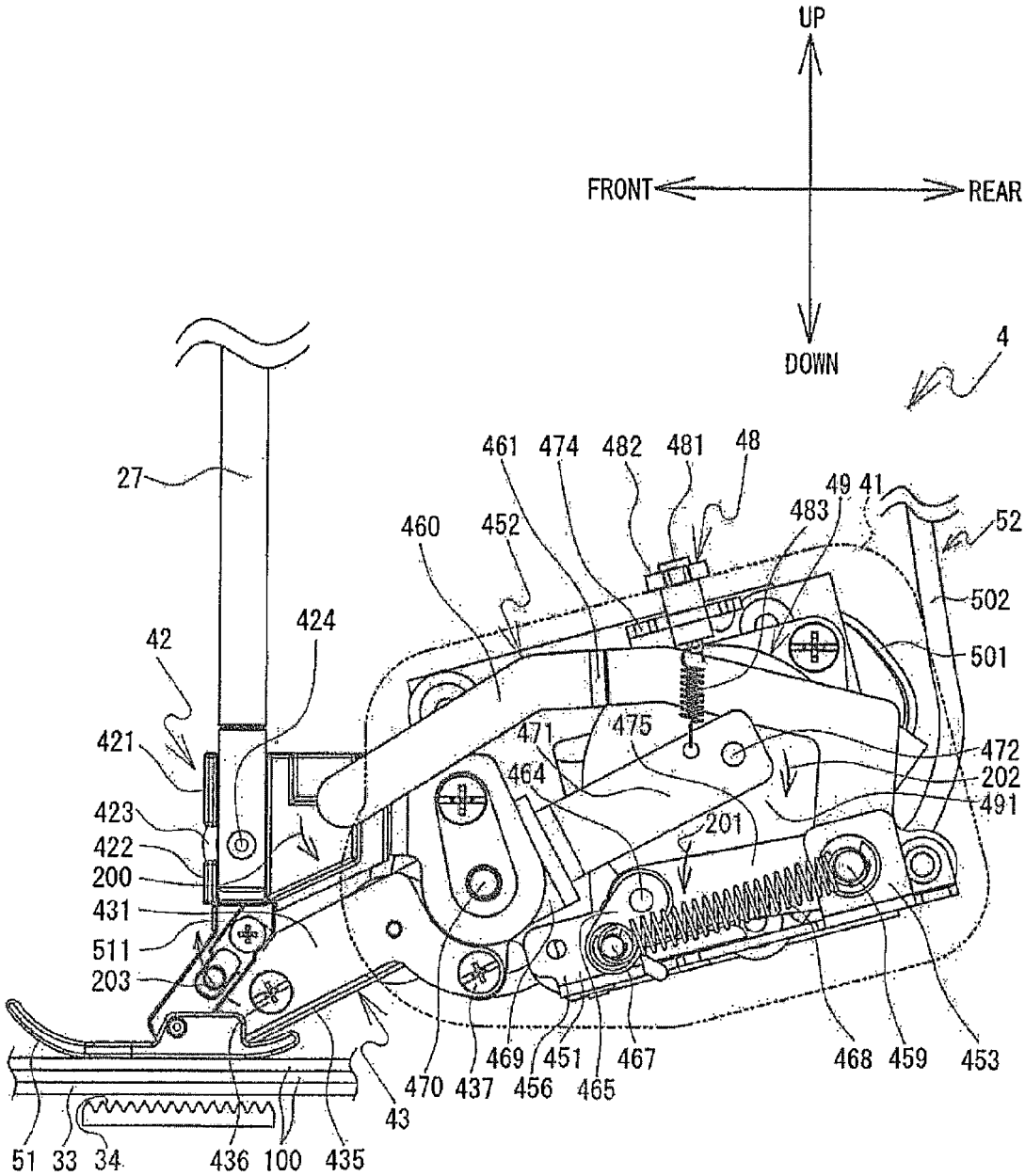
FIG. 5 is a right side view of the upper feed device in the case where the feed mechanism is in the feed position.
Figure 6:
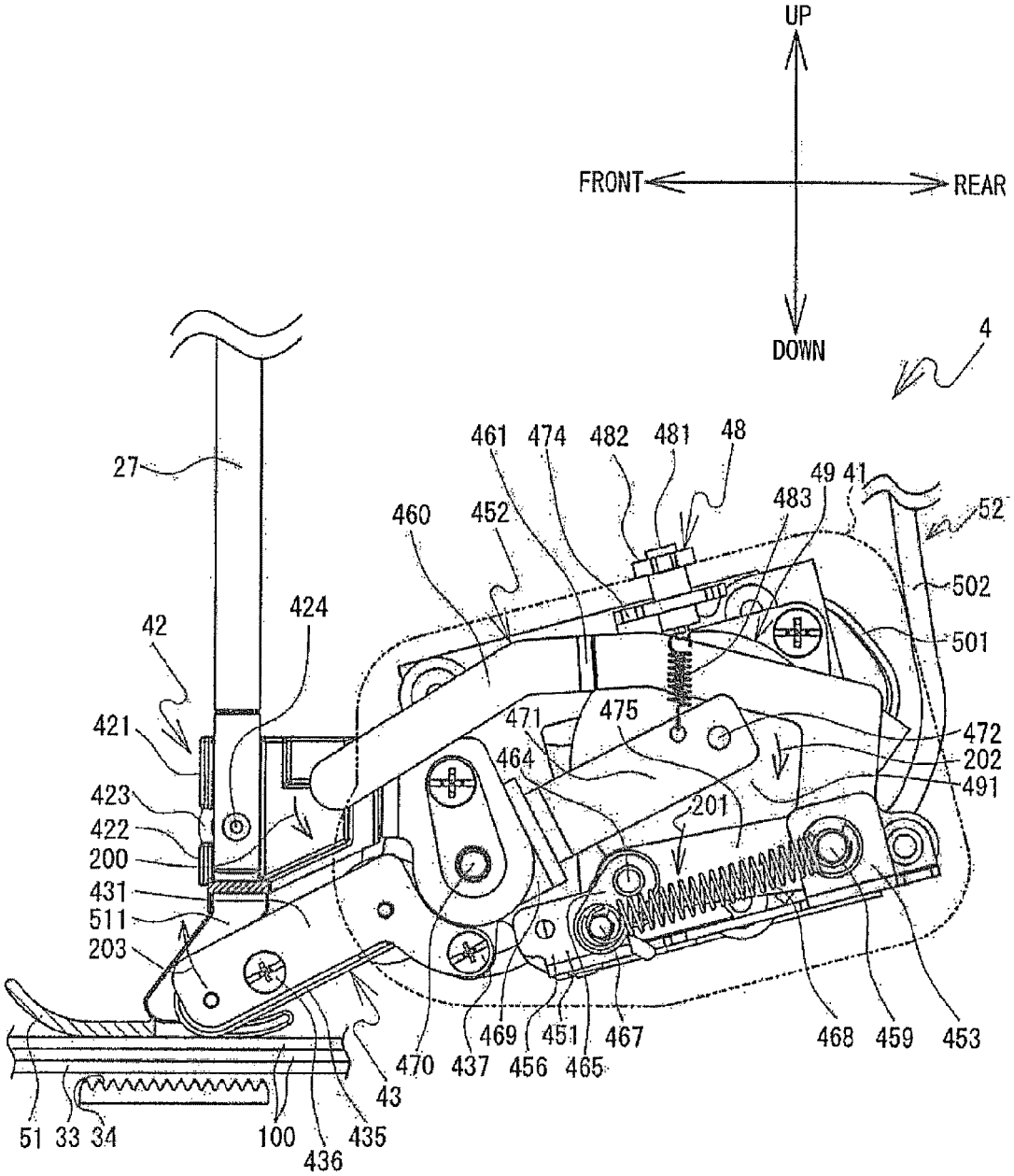
FIG. 6 is a right side view of the upper feed device, with an area around a presser foot in FIG. 5 shown in a cross section to show the front end of the feed mechanism.

The upper feed device 4 will be explained with reference to FIGS. 4 to 13. As shown in FIGS. 4 to 6, the upper feed device 4 includes a housing 41, a mounting portion 42, a feed mechanism 43, a drive mechanism 49, a switching mechanism 45, a pressure adjustment mechanism 48, a connecting portion 52, and a presser foot 51. The mounting portion 42 is a portion by which the upper feed device 4 is mounted on the presser bar 27 of the sewing machine 1. The feed mechanism 43 may feed the work cloth 100. The drive mechanism 49 may drive the feed mechanism 43. The switching mechanism 45 may switch the position of the feed mechanism 43 between a feed position (refer to FIGS. 5 to 8) and a standby position (refer to FIGS. 11 to 13). The feed position is a position in which the feed mechanism 43 can press and feed the work cloth 100. The standby position is a position in which the feed mechanism 43 is separated from the work cloth 100 and does not feed the work cloth 100. The connecting portion 52 electrically may connect a motor 491 to a control portion 60 (refer to FIG. 15) of the sewing machine 1. The motor 491 is included in the drive mechanism 49. The pressure adjustment mechanism 48 may adjust the pressure of a belt 435 on the work cloth 100. The belt 435 is included in the feed mechanism 43.

Figure 7:
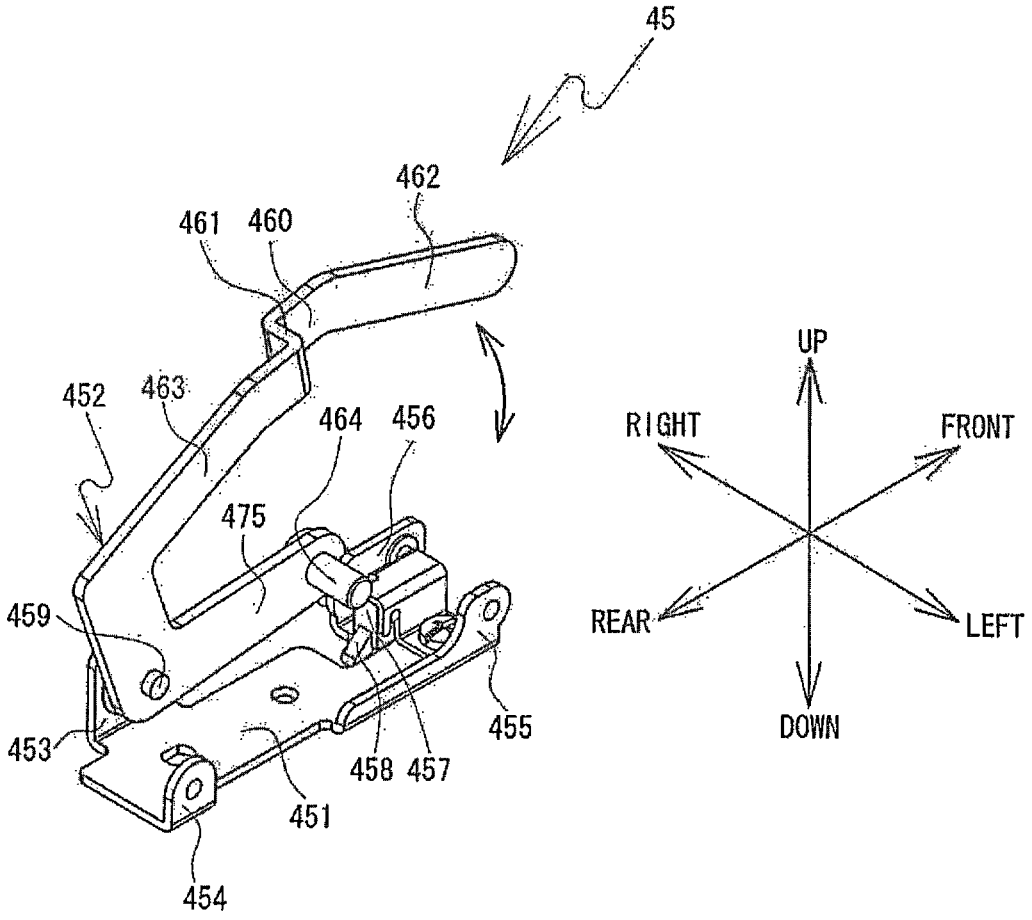
FIG. 7 is an oblique view of a switching mechanism in the case where the feed mechanism is in the feed position.

The switching mechanism 45 is provided inside the housing 41. The switching mechanism 45 includes a base portion 451, a lever plate 452, a spring 468, a detector switch 457, a rotating member 469, and a rotating plate 471. As shown in FIG. 7, the base portion 451 is a plate-shaped member that extends in the front-rear direction at the lower portion inside the housing 41. Bent portions 453, 454, 455, 456 are provided on the side faces of the front and rear ends of the base portion 451. The bent portions 453, 454, 455, 456 are portions that are each bent upward from the base portion 451. The detector switch 457 is provided on the upper side of the front end portion of the base portion 451 (the end portion on the upper right side in FIG. 7). A movable portion 458 is provided on the rear edge of the detector switch 457. The movable portion 458 extends obliquely downward and rearward in a state in which the movable portion 458 is biased in an upward direction. In a case where the movable portion 458 extends obliquely downward and rearward, the detector switch 457 is in an OFF state (refer to FIG. 7). In a case where the movable portion 458 is pressed downward by a shaft member 464 (described below), the movable portion 458 is rotated counterclockwise as seen from the left side. The detector switch 457 then enters an ON state (refer to FIG. 12).

The bent portion 453 is provided at the left rear part of the base portion 451. A shaft member 459 is inserted through the bent portion 453. The plate-shaped lever plate 452 is provided on the left end of the shaft member 459 (the lower right side in FIG. 7). The lever plate 452 can be rotated with the shaft member 459 as the center of rotation. The lever plate 452 includes a lever portion 460 and an extension portion 475. The lever portion 460 extends upward from the location where the shaft member 459 is inserted, and then extends toward the front. The lever portion 460 bends toward the right at a bent portion 461 that is in a central portion of the lever portion 460 in the front-rear direction, and then extends toward the front again. The tip of the lever portion 460 is exposed to the outside of the housing 41. The user may therefore move the lever portion 460 by hand. In the explanation that follows, the part of the lever portion 460 that is toward the front from the position of the bent portion 461 is referred to as the lever front portion 462. The part of the lever portion 460 that is toward the rear from the position of the bent portion 461 is referred to as the lever rear portion 463.

The extension portion 475 extends toward the front from the location where the shaft member 459 is inserted. The shaft member 464 is inserted through the front end portion of the extension portion 475 in the left-right direction. The shaft member 464 may be moved up and down in conjunction with the rotation of the lever plate 452. The left end portion of the shaft member 464 thus may be moved away from and press against the movable portion 458 of the detector switch 457. In this manner, the detector switch 457 may be switched between the OFF state and the ON state.

As shown in FIG. 6, a rear end portion of a linking member 465 is coupled to the right end portion of the shaft member 464. A hole 466 is provided in the bent portion 456 in the right front portion of the base portion 451 (refer to FIG. 4). The hole 466 is slightly elongated in the front-rear direction. A shaft member 467 is inserted through the hole 466. The shaft member 467 can be slid in the front-rear direction within the hole 466. The shaft member 467 is coupled to the front end portion of the linking member 465. The spring 468 is provided such that the shaft member 467 is coupled with the shaft member 459. The spring 468 is provided in an extended state. Therefore, the spring 468 constantly generates a force in the direction of contraction. The shaft member 467 is therefore pulled toward the rear by the spring 468. Accordingly, the shaft member 467 is in contact with the rear end portion of the hole 466 (refer to FIG. 4).

Figure 8:
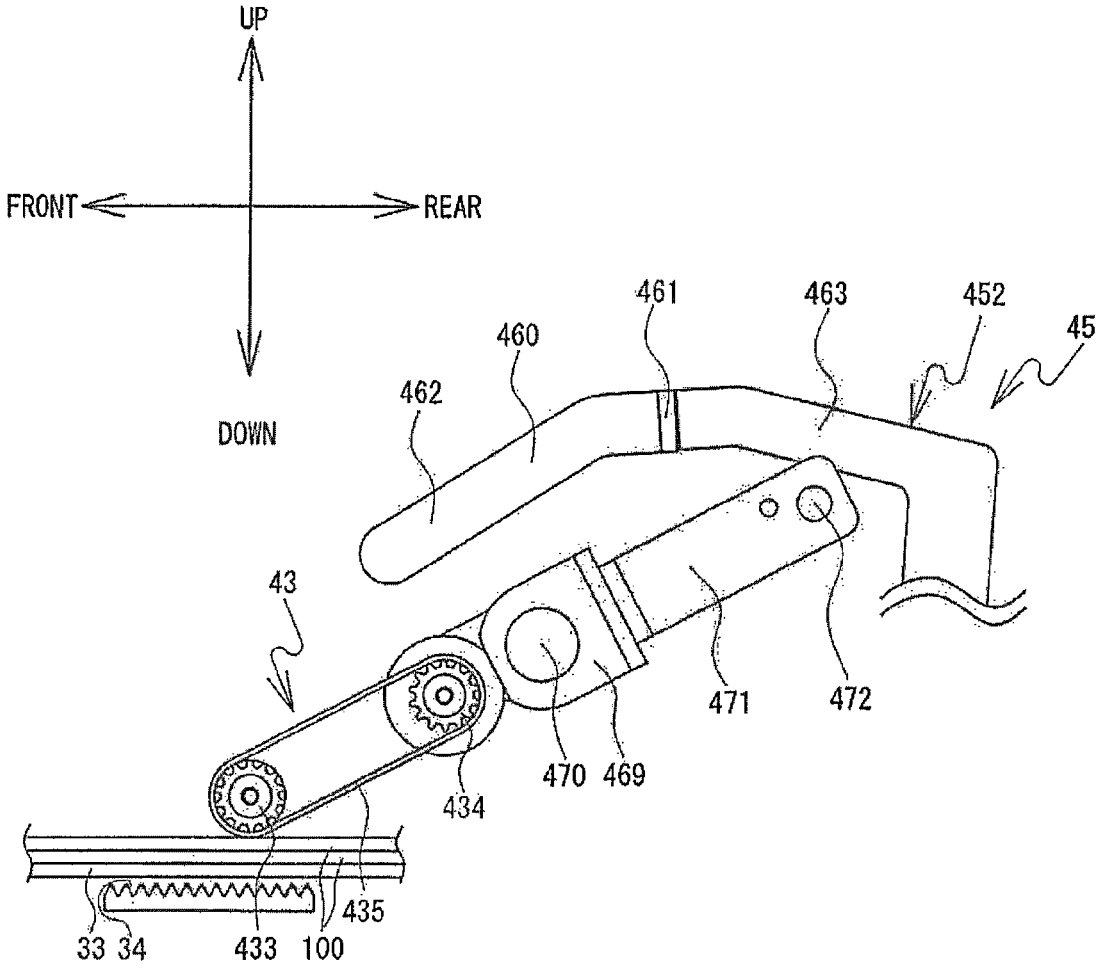
FIG. 8 is a right side view that shows positional relationships among a lever, a rotating plate, and the feed mechanism in the case where the feed mechanism is in the feed position.

As shown in FIGS. 6 and 8, the rotating member 469 is provided above the front end of the base portion 451. The rotating member 469 can be rotated with a central shaft 470 of the rotating member 469 as the center of rotation. The rotating plate 471 is coupled to the rear portion of the rotating member 469. The rotating plate 471 extends obliquely upward and rearward. The rear portion of the rotating plate 471 is positioned to the right of the lever rear portion 463 (refer to FIG. 4). A shaft member 472 extends toward the left from the rear end portion of the rotating plate 471 (refer to FIGS. 6 and 8, not shown in FIG. 4). The shaft member 472 is positioned below the lever rear portion 463. The front end of the rotating member 469 is coupled to the feed mechanism 43.

The feed mechanism 43 will be explained. The feed mechanism 43 extends obliquely downward and forward. The feed mechanism 43 includes plate portions 431, 432 (refer to FIG. 4), pulleys 433, 434, and the belt 435. As shown in FIG. 4, the plate portions 431 and 432 are positioned opposite one another. The plate portions 431 and 432 extend obliquely downward toward the front from the front end of the rotating member 469 (refer to FIG. 6). The front end portions of the plate portions 431 and 432 support the pulley 433 such that the pulley 433 can be rotated. The rear end portions of the plate portions 431 and 432 support the pulley 434 such that the pulley 434 can be rotated. The belt 435 is provided around the pulley 433 and the pulley 434. The front end portion of the belt 435 is positioned at a belt positioning portion 512 (described below) of the presser foot 51 (refer to FIG. 4). The front end portion of the belt 435 may press the work cloth 100 and may feed the work cloth 100 in the front-rear direction. The way in which the position of the feed mechanism 43 is switched by the switching mechanism 45 will be described below. Screws 436 and 437 fix the position of the plate portion 431. In a case where the screws 436 and 437 are removed, the plate portion 431 may be removed from the feed mechanism 43. In a state in which the plate portion 431 has been removed, the user may replace the belt 435 with another belt.

A structure for adjusting the pressure when the feed mechanism 43 presses the work cloth 100 will be explained. A lower edge portion of a plate portion 473 (refer to FIG. 4) is fixed by screws (not shown in the drawings) to the bent portions 454 and 455 on the left side of the base portion 451 (refer to FIG. 7). As shown in FIG. 4, the plate portion 473 extends upward. An extension portion 474 that extends toward the right is provided in a central portion of the upper edge of the plate portion 473 in the front-rear direction. The extension portion 474 is positioned above the motor 491 (described below). The pressure adjustment mechanism 48 is provided on the right end portion of the extension portion 474.

The pressure adjustment mechanism 48 includes a male threaded portion 481, a female threaded portion 482, and a spring 483. The male threaded portion 481 penetrates in the up-down direction through the top face of the housing 41 and through the extension portion 474. The female threaded portion 482 is located on the top side of the top face of the housing 41 above the extension portion 474 (refer to FIG. 5). The upper end portion of the male threaded portion 481 is inserted through the female threaded portion 482. The upper end portion of the spring 483 is fixed to the lower end portion of the male threaded portion 481. The spring 483 extends downward. The lower end portion of the spring 483 is fixed to the rear end portion of the rotating plate 471. The spring 483 pulls the rear end portion of the rotating plate 471 upward. The male threaded portion 481 is moved in the up-down direction when the female threaded portion 482 is turned. When the male threaded portion 481 is moved upward, the spring 483 is extended. Therefore, the force with which the spring 483 pulls the rear end portion of the rotating plate 471 upward becomes stronger. When the rotating plate 471 is pulled upward, a force is applied to the feed mechanism 43 in a counterclockwise direction as seen from the right side, with the central shaft 470 serving as the center of rotation. Therefore, the force with which the front end portion of the belt 435 presses downward against the work cloth 100 becomes stronger. When the male threaded portion 481 is moved downward, the spring 483 contracts. Therefore, the force with which the spring 483 pulls the rear end portion of the rotating plate 471 upward becomes weaker. Accordingly, the force with which the belt 435 presses against the work cloth 100 becomes weaker. In this manner, the force with which the belt 435 presses against the work cloth 100 can be adjusted by adjusting pressure adjustment mechanism 48.

The mounting portion 42 and the presser foot 51 will be explained. As shown in FIG. 4, the mounting portion 42 is provided above the feed mechanism 43 in the front end portion of the upper feed device 4. The mounting portion 42 includes two holding portions 421 and 422. The holding portions 421 and 422 are mounted on and fixed to the presser bar 27 by a shoulder screw 423. The shoulder screw 423 includes a head 425, a shank 426, and a threaded portion 424. The outside diameter of the shank 426 is slightly smaller than the outside diameter of the head 425. The outside diameter of the threaded portion 424 is slightly smaller than the outside diameter of the shank 426. The holding portions 421 and 422 are provided on the front end of the upper feed device 4. The holding portion 421 is provided above the holding portion 422 and is set apart slightly from the holding portion 422. Each of the holding portions 421 and 422 has a recessed portion that is recessed toward the left. The lower end portion of the presser bar 27 may be disposed in the recessed portions. A threaded hole (not shown in the drawings) is provided in the lower end portion of the presser bar 27. The threaded hole extends through the presser bar 27 in the left-right direction. The threaded portion 424 may be screwed into the threaded hole. A slot (not shown in the drawings) is formed in the left side face of the head 425. A tool (not shown in the drawings), which will be described below, may be fitted into the slot.

When mounting the upper feed device 4 to the presser bar 27, the user may match the position of the threaded portion 424 to that the position of the threaded hole in the presser bar 27. In that state, the user may turn the head 425 with his fingers or may fit the tool into the slot to turn the head 425. The right side face of the shank 426 may thus come into contact with the left side faces of the holding portions 421 and 422. In that state, if the shoulder screw 423 is turned and tightened, the holding portions 421 and 422 are clamped between the shank 426 and the presser bar 27. In that state, the holding portions 421 and 422 are fixed to the presser bar 27. The upper feed device 4 may thus be mounted to the presser bar 27.

As shown in FIG. 4, a presser foot support portion 511 is provided on the lower edge portion of the holding portion 422. The presser foot support portion 511 straddles the front end portion of the feed mechanism 43 at the left and right. The presser foot support portion 511 extends obliquely downward and forward. The presser foot 51 is provided on the lower end of the presser foot support portion 511. The sewing needle 29 may pass through a hole 513 in the presser foot 51. The belt positioning portion 512 is provided at the rear of the hole 513. The belt positioning portion 512 is a rectangular open portion that extends to the rear edge of the presser foot 51. The front end portion of the belt 435 of the feed mechanism 43 may be disposed on the inner side of the belt positioning portion 512. When the feed mechanism 43 is in the feed position, the front end portion of the belt 435 may feed the work cloth 100 while pressing downward against the work cloth 100 in the belt positioning portion 512.

The upper feed device 4 may be mounted to the presser bar 27 by the mounting portion 42. Therefore, when the presser bar 27 is moved upward, the upper feed device 4 is also moved upward. The presser foot 51 is also moved away from the work cloth 100. When the presser bar 27 is moved downward, the upper feed device 4 is also moved downward. The presser foot 51 also presses downward against the work cloth 100.

Figure 9:
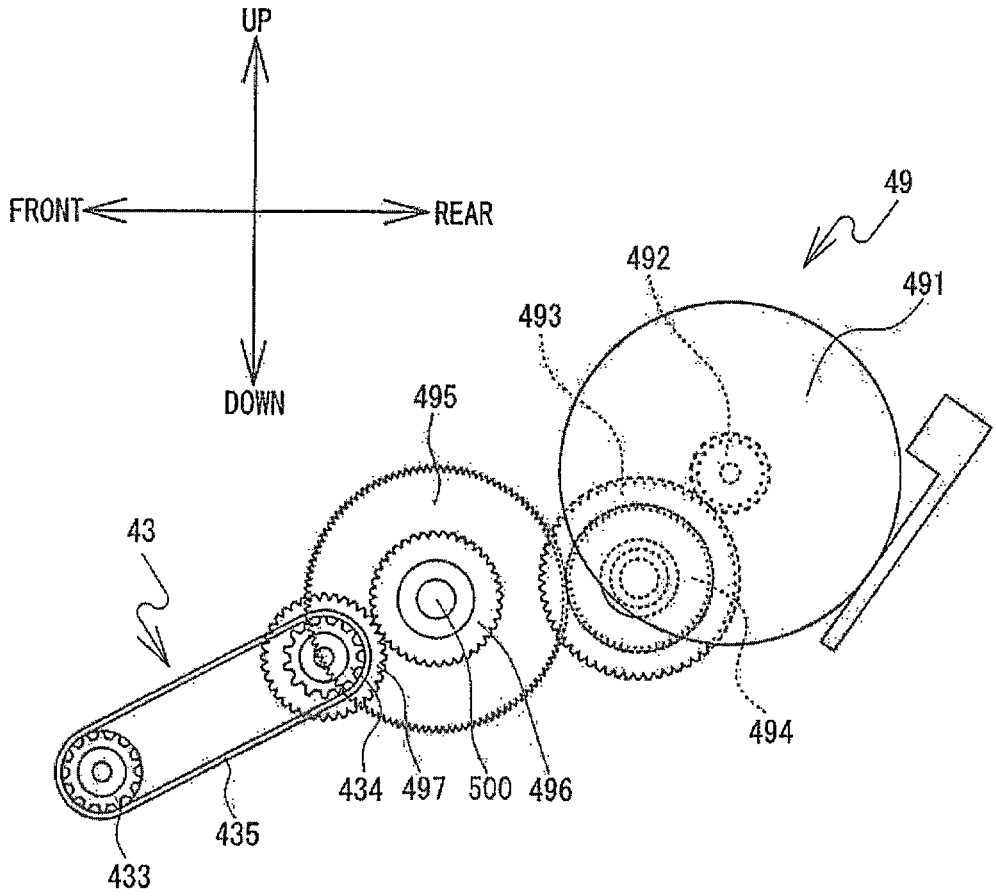
FIG. 9 is a right side view of a drive mechanism that may drive a belt.
Figure 10:
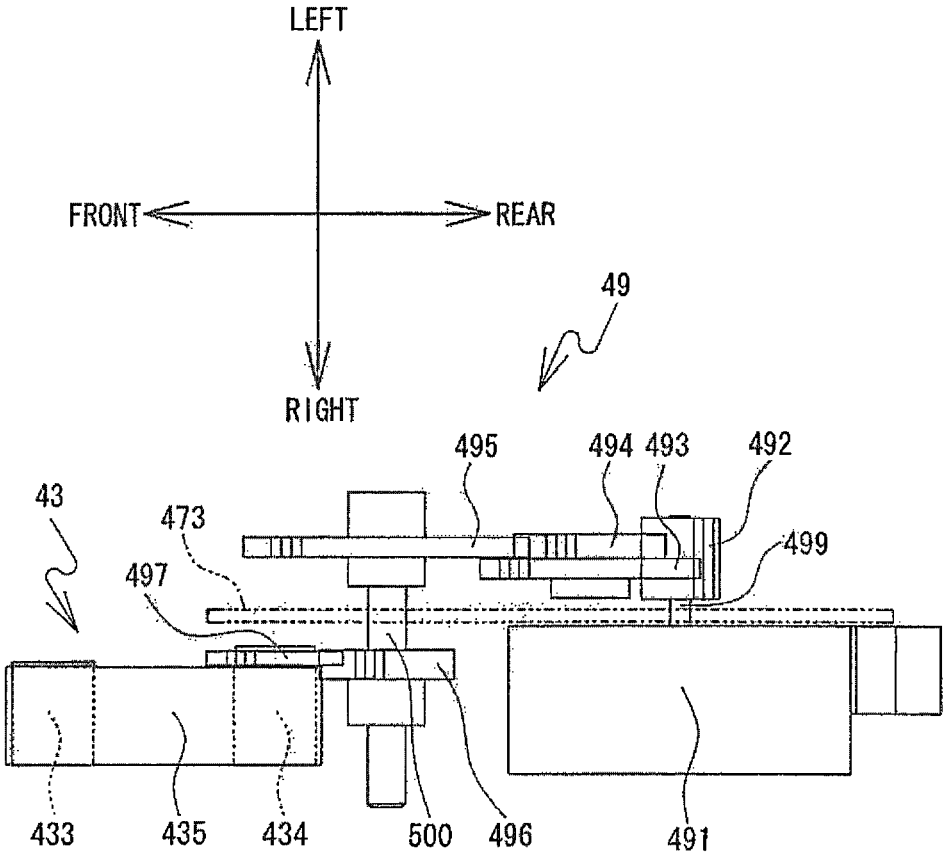
FIG. 10 is a plan view of the drive mechanism that may drive the belt.
Figure 11:
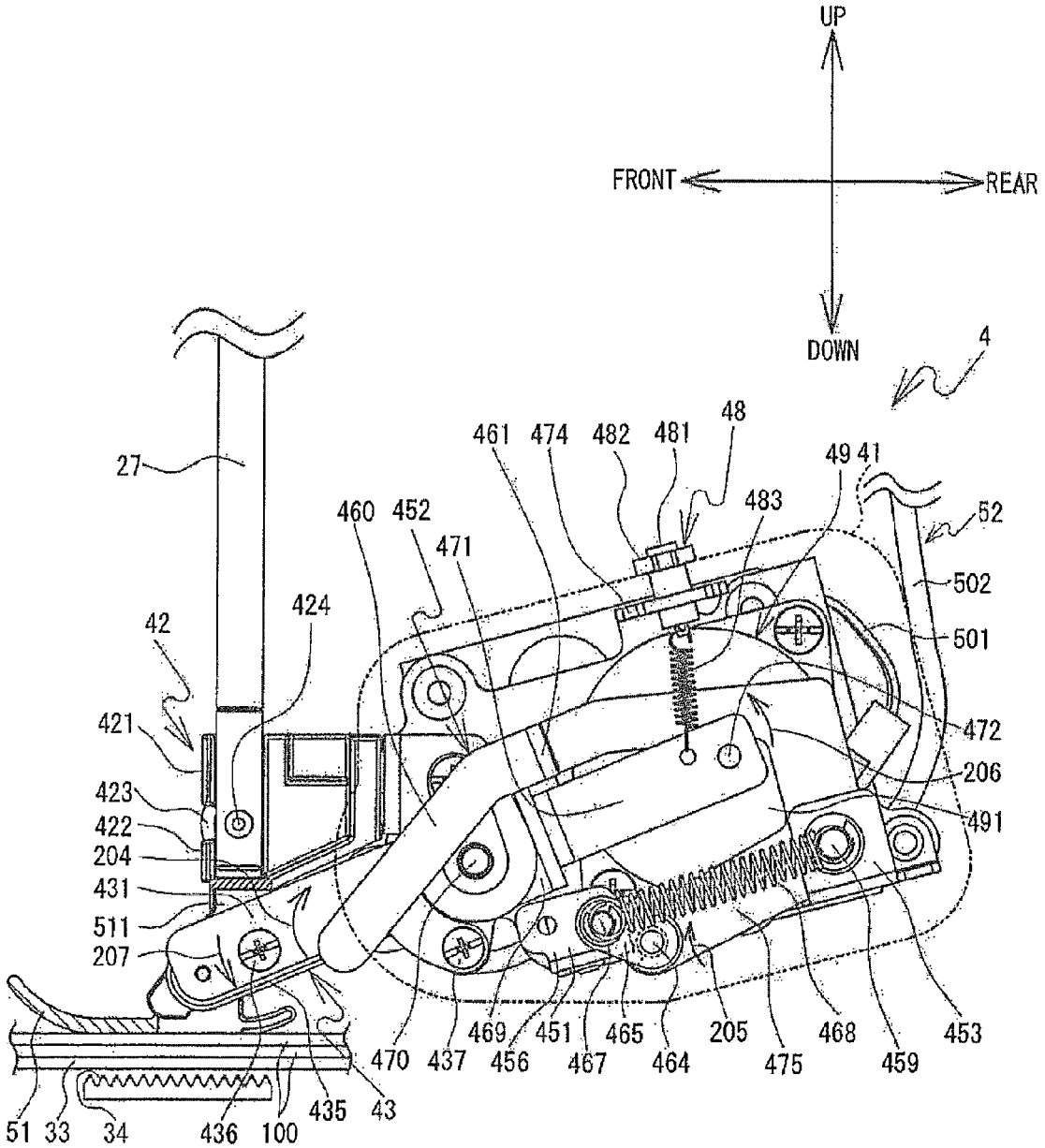
FIG. 11 is a right side view of the upper feed device in a case where the feed mechanism that is shown in FIG. 6 is moved to a standby position.

The drive mechanism 49 will be explained. As shown in FIGS. 9 and 10, the drive mechanism 49 includes the motor 491, gears 492 to 497, and an electric substrate 498 (refer to FIG. 4). The motor 491 is positioned above the base portion 451 and on the right side of the plate portion 473 (refer to FIGS. 4 and 10). A drive shaft 499 of the motor 491 extends through the plate portion 473 and protrudes from the left side of the plate portion 473 (refer to FIG. 10). The gear 492 is fixed to the projecting end of the drive shaft 499. The gear 493 is positioned obliquely below and at the front of the gear 492. The gear 492 meshes with the gear 493. The gear 494 is provided on the left side face of the gear 493. The diameter of the gear 494 is smaller than the diameter of the gear 493. The gears 493 and 494 are formed as a single unit. The gear 495 is positioned in front of the gear 494. The gear 494 meshes with the gear 495. The gear 495 is provided around a central shaft 500. The central shaft 500 extends through the plate portion 473 and protrudes from the right side of the plate portion 473 (refer to FIG. 10). The gear 496 is provided around the central shaft 500 at the right of the plate portion 473. The gear 496 meshes with the gear 497, which is in front of the gear 496. The gear 497 is formed as a single unit with the pulley 434 of the feed mechanism 43. The electric substrate 498 (refer to FIG. 4) is positioned at the left of the plate portion 473 and the gear 495. The motor 491 is connected to the electric substrate 498 through a lead wire 501 (refer to FIGS. 4 to 6).

Figure 15:
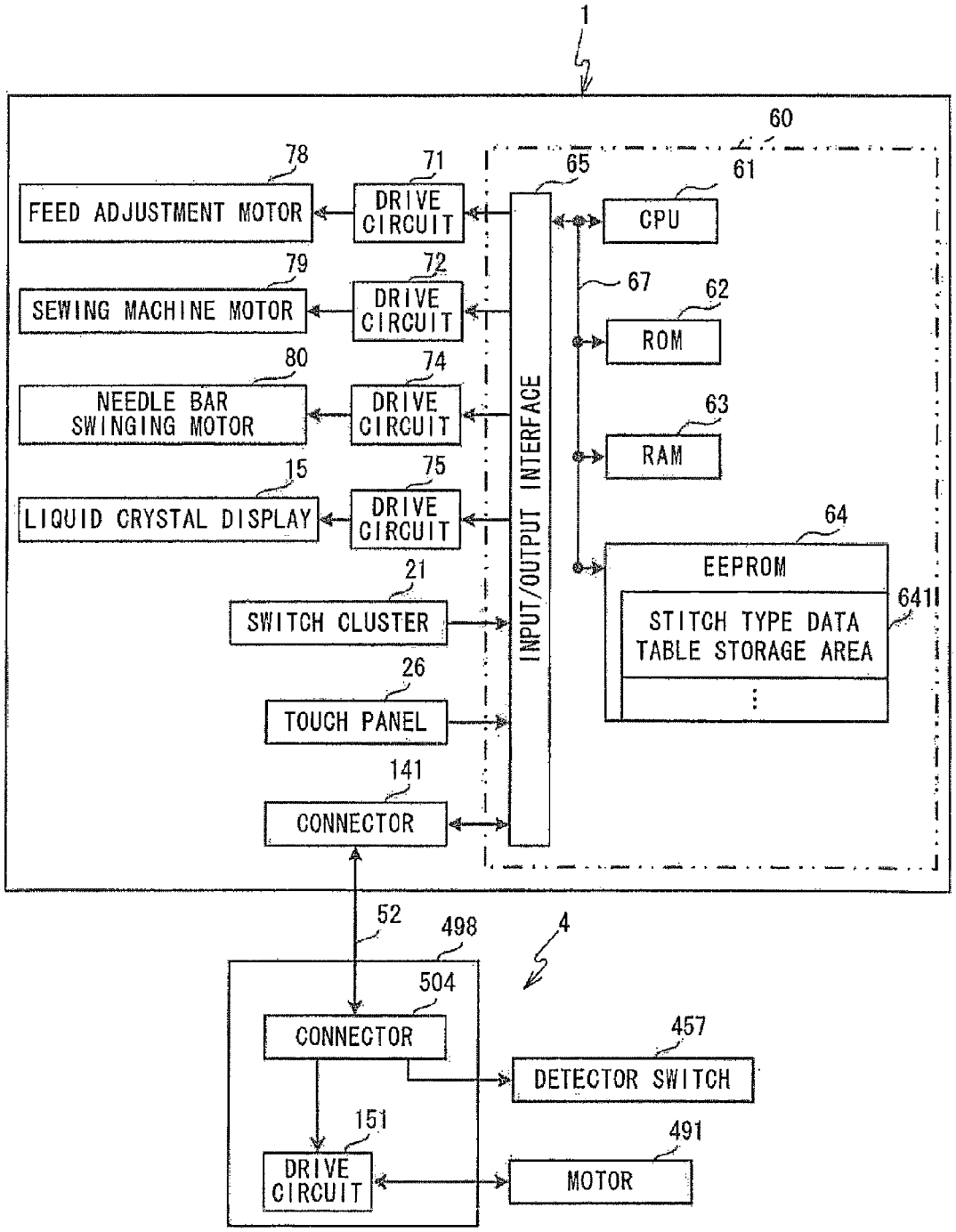
FIG. 15 is a block diagram that shows an electrical configuration of the sewing machine and the upper feed device.

The connecting portion 52 is connected to the electric substrate 498 via a connector 504 (refer to FIG. 15). As shown in FIG. 3, the connecting portion 52 includes a lead wire 502 and a connector 503. The lead wire 502 extends from the electrical circuit board 498 to the outside of the housing 41 of the upper feed device 4. The connector 503 is provided on one end of the lead wire 502. The connector 503 may be connected to a connector 141. The connector 141 is provided in the head 14 of the sewing machine 1. The connector 141 is electrically connected to the control portion 60 of the sewing machine 1 (refer to FIG. 15). The motor 491 may be electrically connected to the control portion 60 of the sewing machine 1 via the electric substrate 498, the lead wire 502, and the connector 503. In other words, the motor 491 and the control portion 60 of the sewing machine 1 may be electrically connected via the connecting portion 52. The CPU 61 may control the operation of the motor 491.

When the motor 491 turns, the pulley 434 is rotated via the gears 492 to 497. When the pulley 434 is rotated, the belt 435 is moved. The pulley 433 is rotated in conjunction with the moving of the belt 435. The belt 435 can feed the work cloth 100 by moving while making contact with the work cloth 100. Furthermore, the control portion 60 can perform control that synchronizes the timing of the operation by which the upper feed device 4 feeds the work cloth 100 and the timing of the operation by which the feed dog 34 feeds the work cloth 100. Accordingly, the upper feed device 4 and the feed dog 34 can operate in coordination to feed the work cloth 100.

The way in which the position of the feed mechanism 43 is switched between the feed position (refer to FIGS. 6 to 8) and the standby position (refer to FIGS. 11 to 13) will be explained. First, a case will be explained in which the position of the feed mechanism 43 is switched from the feed position to the standby position. In a case where the user switches the position of the feed mechanism 43 from the feed position to the standby position, the user may press the lever portion 460 downward (refer to the arrow 200 in FIG. 6). When the lever portion 460 is pressed downward, the lever plate 452 is rotated counterclockwise as seen from the right side, with the shaft member 459 as the center of rotation. That causes the extension portion 475 of the lever plate 452 and the shaft member 464 to rotate downward (refer to the arrow 201 in FIG. 6), so that the shaft member 467 is pushed toward the front via the linking member 465. Then the shaft member 467 slides toward the front within the hole 466 (refer to FIG. 4) against the contracting force of the spring 468.

When the shaft member 464 is moved lower than the spring 468, the shaft member 467 is pulled toward the rear by the contracting force of the spring 468 and by the movement of the linking member 465. Therefore, the shaft member 467 slides toward the rear within the hole 466. When the shaft member 467 is moved to the rear end of the hole 466, the rotation of the lever plate 452 stops (refer to FIG. 11).

In the process of the rotating of the lever plate 452, the lower edge of the lever rear portion 463 comes into contact with the shaft member 472 and pushes the shaft member 472 downward. The rotating plate 471, on which the shaft member 472 is provided, is then rotated downward, with the central shaft 470 of the rotating member 469 as the center of rotation (refer to the arrow 202 in FIG. 6). Therefore, the feed mechanism 43 is rotated upward, with the central shaft 470 as the center of rotation (refer to the arrow 203 in FIG. 6). The belt 435 of the feed mechanism 43 is thereby moved away from the work cloth 100 (refer to FIG. 11). In other words, the position of the feed mechanism 43 is switched from the feed position (refer to FIGS. 6 to 8) to the standby position (refer to FIGS. 11 to 13). The contracting force of the spring 468 operates constantly. Therefore, even if the user removes the user's hand from the lever portion 460, the shaft member 467 can be held in the state in which the shaft member 467 has been moved to the rear end of the hole 466. The shaft member 464 can therefore be held in the state in which the shaft member 464 is positioned lower than the spring 468. Therefore, the position of the feed mechanism 43 can be held in the state in which the position of the feed mechanism 43 has been switched to the standby position.

Figure 12:
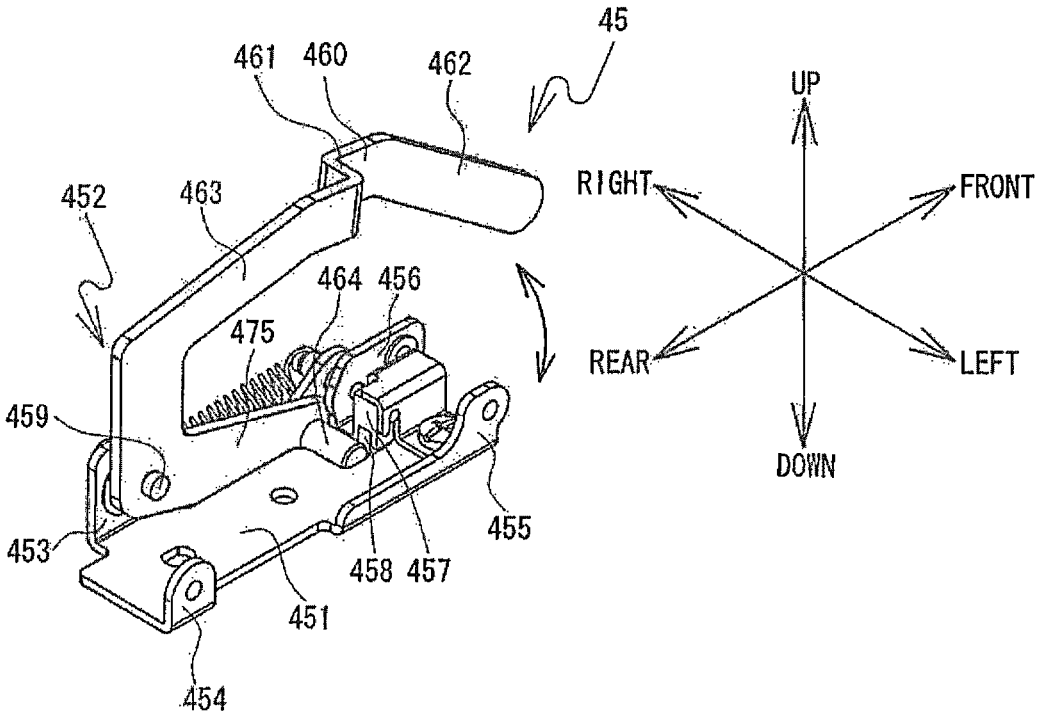
FIG. 12 is an oblique view of the switching mechanism in the case where the feed mechanism is in the standby position.
Figure 13:
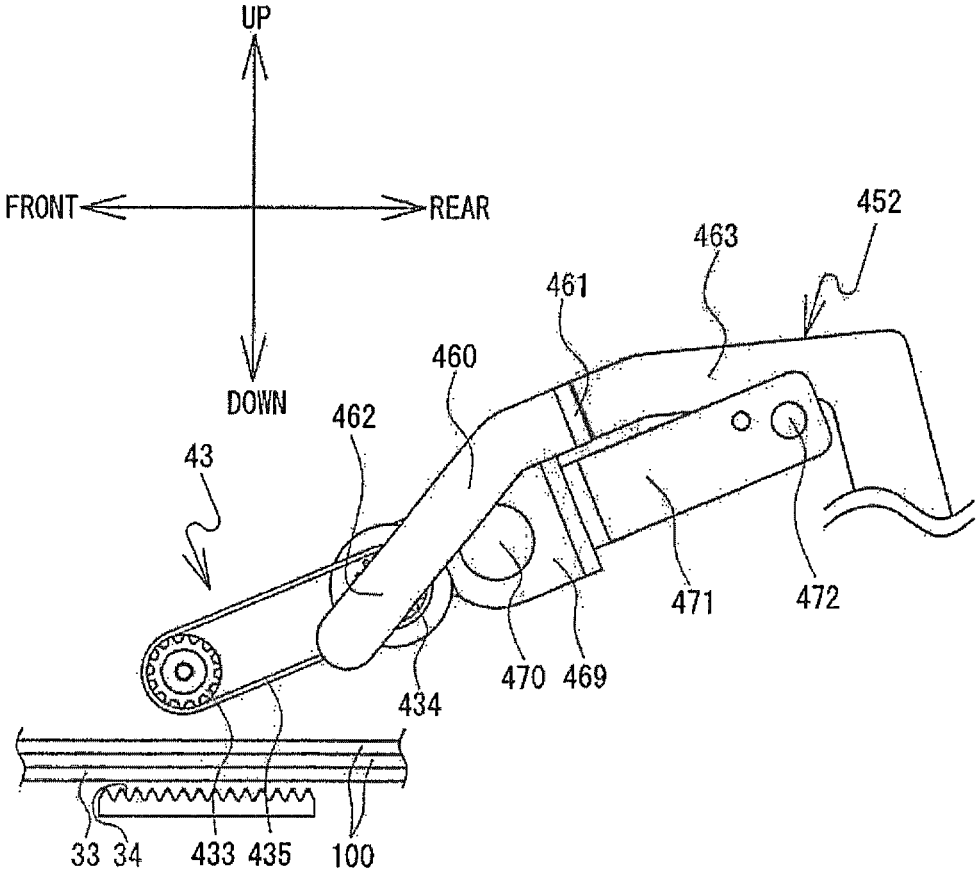
FIG. 13 is a figure that shows positional relationships among the lever, the rotating plate, and the feed mechanism in the case where the feed mechanism is in the standby position.

In the process of the switching of the position of the feed mechanism 43 from the feed position to the standby position (refer to FIGS. 11 to 13), the left end of the shaft member 464 of the extension portion 475 pushes the movable portion 458 of the detector switch 457 downward (refer to FIG. 12). The detector switch 457 is thereby switched from the OFF state to the ON state. The CPU 61 of the sewing machine 1 can thus detect that the feed mechanism 43 has been switched from the feed position to the standby position.

Next, a case will be explained in which the position of the feed mechanism 43 is switched from the standby position (refer to FIGS. 11 to 13) to the feed position (refer to FIGS. 6 to 8). In a case where the user switches the position of the feed mechanism 43 from the standby position to the feed position, the user may press the lever portion 460 upward. In this case, the lever portion 460 and the extension portion 475 operate in the opposite way from how the lever portion 460 and the extension portion 475 operate in the case that was described above, where the position of the feed mechanism 43 is switched from the feed position to the standby position (refer to the arrows 204 and 205 in FIG. 11).

When the lever portion 460 is rotated upward, the lever rear portion 463 begins to be moved away from the shaft member 472, which is provided in the rotating plate 471. The rotating plate 471 is pulled upward by the spring 483 of the pressure adjustment mechanism 48. The rotating plate 471 is therefore rotated upward, with the central shaft 470 as the center of rotation (refer to the arrow 206 in FIG. 11). Therefore, the feed mechanism 43 is rotated downward (refer to the arrow 207 in FIG. 11). The front end portion of the belt 435 of the feed mechanism 43 may thereby press downward against the work cloth 100. In other words, the feed mechanism 43 is switched to the feed position. In this state, the upper feed device 4 may operate in coordination with the feed dog 34 to feed the work cloth 100.

Figure 14:
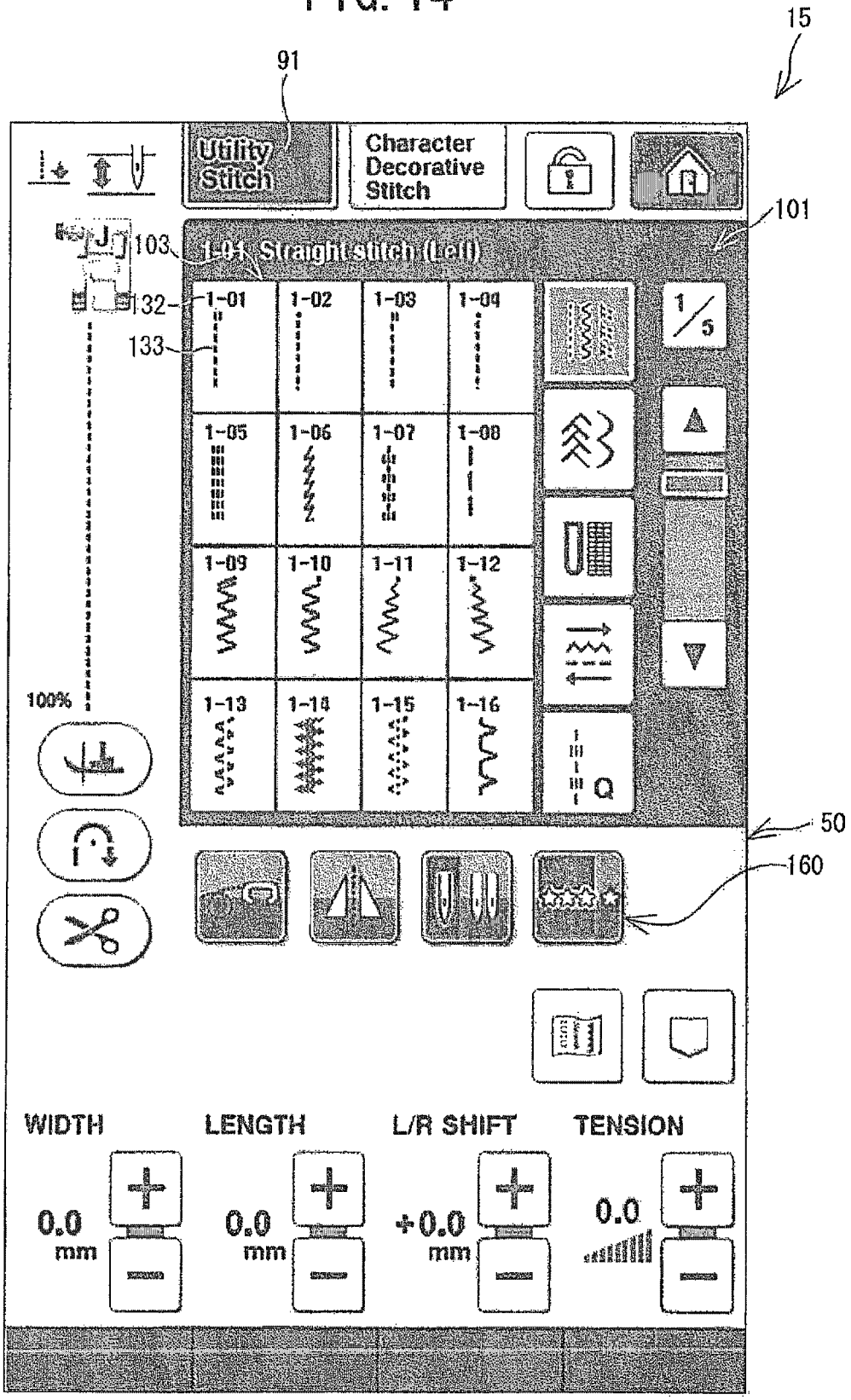
FIG. 14 is a figure that shows a state in which an ordinary selection screen is displayed on a liquid crystal display.

Images that are displayed on the liquid crystal display 15 will be explained with reference to FIG. 14. As shown in FIG. 14, a utility stitch key 91 and the like, for example, may be displayed along the top of the liquid crystal display 15. In a case where the utility stitch key 91 is selected by a panel operation, stitch type selection keys 103 for utility stitches may be displayed in a first display area 101 (described below), as shown in FIG. 14. The stitch type selection keys 103 for the utility stitches are used for selecting utility stitch types to be formed by the sewing machine 1. The utility stitch types include a straight stitch, a zigzag stitch, an overcasting stitch, a buttonhole stitch, a transverse stitch, and the like, for example. The transverse stitch type will be explained below.

The first display area 101 may be displayed below the utility stitch key 91. The stitch type selection keys 103 and the like may be displayed in the first display area 101. Some (sixteen in FIG. 14) of the stitch type selection keys 103 may be displayed in the first display area 101. A stitch type number 132 and a stitch type pattern 133 may be displayed on each of the stitch type selection keys 103. The stitch type number 132 is a number that identifies each of the stitch types. The stitch type pattern 133 shows a simplified version of the shape of the stitch type. The CPU 61 can display the stitch type selection keys 103 by referencing a stitch type data table that will be described below. The user may perform a panel operation on one of the stitch type selection keys 103 while looking at the stitch type number 132 and the stitch type pattern 133. In that way, the user can select a stitch type for performing sewing. A second display area 160 may be provided below the first display area 101. Function keys 50 may be displayed in the second display area 160. The function keys 50 are used for making settings for the stitch types.

The stitch type data table will be explained. The stitch type data table is stored in a stitch type data table storage area 641 of an EEPROM 64 (described below, refer to FIG. 15). In the stitch type data table, the stitch type number, stitch type pattern data, sewing data, and an upper feed device use flag are stored in association with each of the stitch types. The stitch type pattern data are data for displaying the stitch type patterns 133 on the stitch type selection keys 103. The sewing data are data for performing the sewing that corresponds to the stitch type patterns 133. The CPU 61 can cause the sewing machine 1 to sew the stitch types in accordance with the sewing data. The upper feed device use flag is a flag that indicates whether the upper feed device 4 is to be used in a case where the sewing is performed based on the sewing data. A stitch type for which the associated upper feed device use flag is set to "1" is a stitch type that can be sewn while the work cloth 100 is fed by using the upper feed device 4. A stitch type for which the associated upper feed device use flag is set to "0" is a stitch type that is to be sewn without using the upper feed device 4. Hereinafter, a stitch type that can be sewn while the work cloth 100 is fed by using the upper feed device 4 is referred to as an upper feed enabled stitch type. Hereinafter, a stitch type that is sewn without using the upper feed device 4 is referred to as an upper feed disabled stitch type. An example of the upper feed disabled stitch type is the transverse stitch type, which is mentioned above. The transverse stitch type is a stitch type that is to be sewn while the work cloth 100 is fed to one of the left and the right by operating the feed dog 34 so as to be moved in the left-right direction.

The electrical configuration of the sewing machine 1 will be explained with reference to FIG. 15. As shown in FIG. 15, the control portion 60 of the sewing machine 1 includes the CPU 61, a ROM 62, a RAM 63, the EEPROM 64, and an input/output interface 65, all of which are connected to one another via a bus 67. ROM 62 stores programs for the CPU 61 to perform processing, as well as data and the like. EEPROM 64 includes the stitch type data table storage area 641. The above-described stitch type data table is stored in the stitch type data table storage area 641. EEPROM 64 also stores upper limit values and lower limit values for a stitch length, thread tension, and the like, as well as optimum values and set values, for each of the stitch types. EEPROM 64 also stores various types of other data. RAM 63 may store various types of temporary data.

The switch cluster 21, the touch panel 26, drive circuits 71, 72, 74, 75, and the connector 141 are electrically connected to the input/output interface 65. The drive circuit 71 may drive the feed adjustment motor 78. The drive circuit 72 may drive the sewing machine motor 79. The drive circuit 74 may drive the needle bar swinging motor 80. The drive circuit 75 may drive the liquid crystal display 15.

The connector 141 may be connected to one end of the connecting portion 52. The connecting portion 52 is connected to the connector 504. The connector 504 and a drive circuit 151 are mounted on the electric substrate 498. The connector 504 is electrically connected to the detector switch 457 (refer to FIGS. 7 and 15) and the drive circuit 151. The drive circuit 151 may drive the motor 491. By controlling the drive circuit 151, the CPU 61 can control the driving of the motor 491. The CPU 61 also can detect the output (the ON state or the OFF state) of the detector switch 457.

Although this is not shown in the drawings, the circuitry is configured such that a Low signal is input to the CPU 61 in a case where the upper feed device 4 is connected via the connector 141. Furthermore, the circuitry is configured such that a High signal is input to the CPU 61 in a case where the upper feed device 4 is not connected via the connector 141. By detecting one of the Low signal and the High signal, the CPU 61 can detect whether the motor 491 and the control portion 60 are electrically connected.

Figure 16:
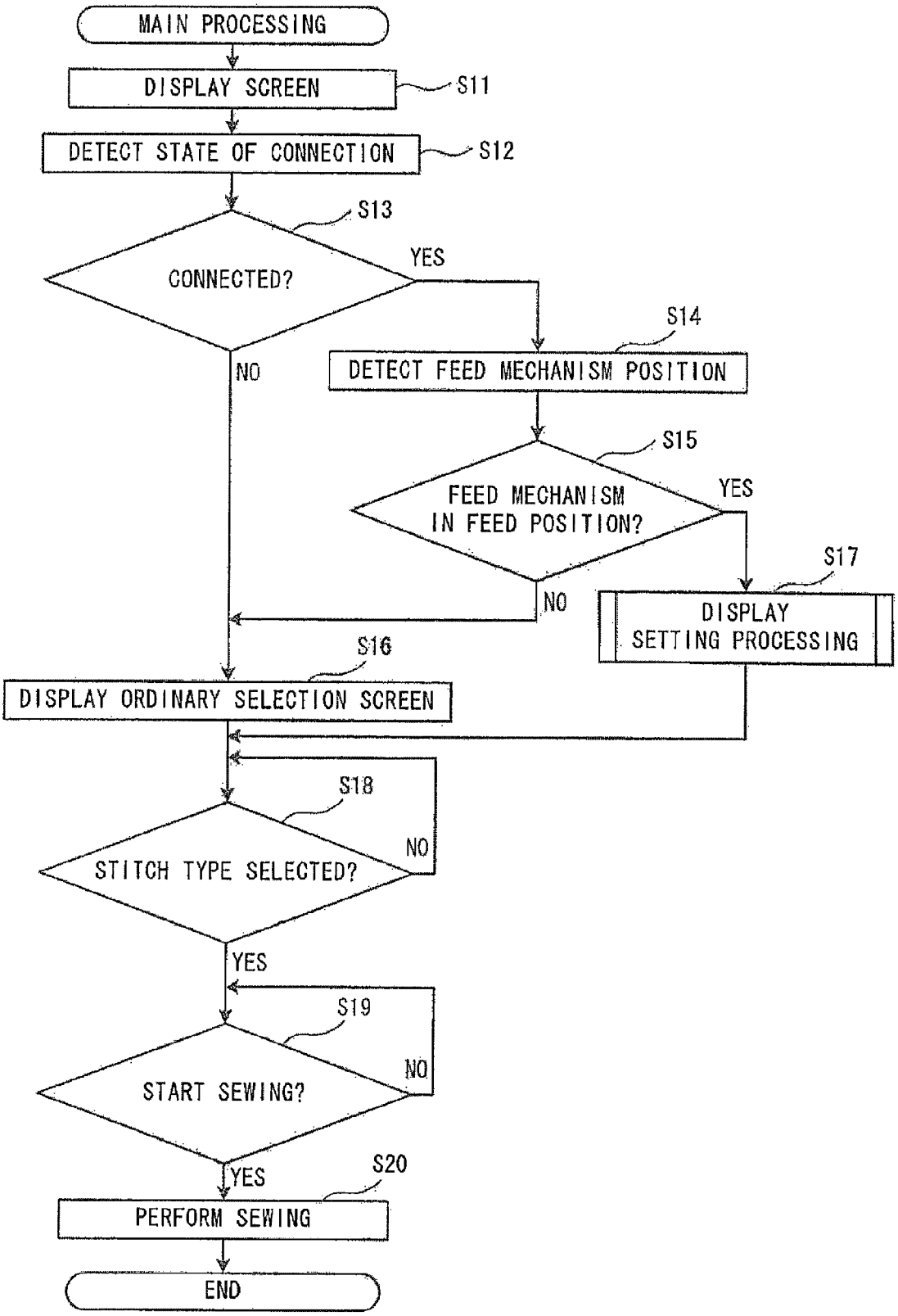
FIG. 16 is a flowchart of main processing.

Main processing will be explained with reference to the flowchart in FIG. 16. The main processing is performed by the CPU 61 of the sewing machine 1 in accordance with a program that is stored in the ROM 62. The main processing is performed in a case where, for example, a panel operation is performed on the utility stitch key 91. As shown in FIG. 16, first, a screen for selecting a utility stitch type is displayed on the liquid crystal display 15 (Step S11). In the processing at Step S11, the screen that is shown in FIG. 14 may be displayed, for example. As shown in FIG. 14, the stitch type selection keys 103 are displayed in the first display area 101. The stitch type pattern 133 and the stitch type number 132 are displayed on each of the stitch type selection keys 103. The stitch type patterns 133 are displayed based on the stitch type data in the stitch type data table that is stored in the EEPROM 64.

Next, the CPU 61 detects whether the motor 491 and the control portion 60 are electrically connected by the connecting portion 52 of the upper feed device 4 (Step S12). Specifically, as described above, by detecting one of the Low signal and the High signal, the CPU 61 can detect whether the motor 491 and the control portion 60 are electrically connected. Next, a determination is made as to whether the result of the detection at Step S12 is that the motor 491 and the control portion 60 are electrically connected (Step S13). In other words, a determination is made as to whether the upper feed device 4 and the sewing machine 1 are connected via the connecting portion 52. In a case where the motor 491 and the control portion 60 are not electrically connected (NO at Step S13), an ordinary selection screen is displayed (Step S16). The ordinary selection screen is a screen on which settings that are made in a case where the processing at Step S33 (refer to FIG. 17), which will be described below, is performed have not been made. The ordinary selection screen may be the screen that is shown in FIG. 14, for example. In other words, the screen that was displayed at Step S11 (refer to FIG. 14) continues to be displayed. Next, the processing at Step S18, which will be described below, is performed.

In a case where the motor 491 and the control portion 60 are electrically connected (YES at Step S13), the position of the feed mechanism 43 (one of the feed position and the standby position) is detected (Step S14). Specifically, the state of the detector switch 457 is detected. If the detector switch 457 is in the OFF state, the CPU 61 detects that the feed mechanism 43 is in the feed position (refer to FIGS. 6 to 8). If the detector switch 457 is in the ON state, the CPU 61 detects that the feed mechanism 43 is in the standby position (refer to FIGS. 11 to 13).

Next, a determination is made as to whether the result of the detection at Step S14 is that the feed mechanism 43 is in the feed position (Step S15). In a case where the feed mechanism 43 is in the standby position (NO at Step S15), the ordinary selection screen is displayed (Step S16). In a case where the feed mechanism 43 is in the feed position (YES at Step S15), display setting processing is performed (Step S17).

Figure 17:
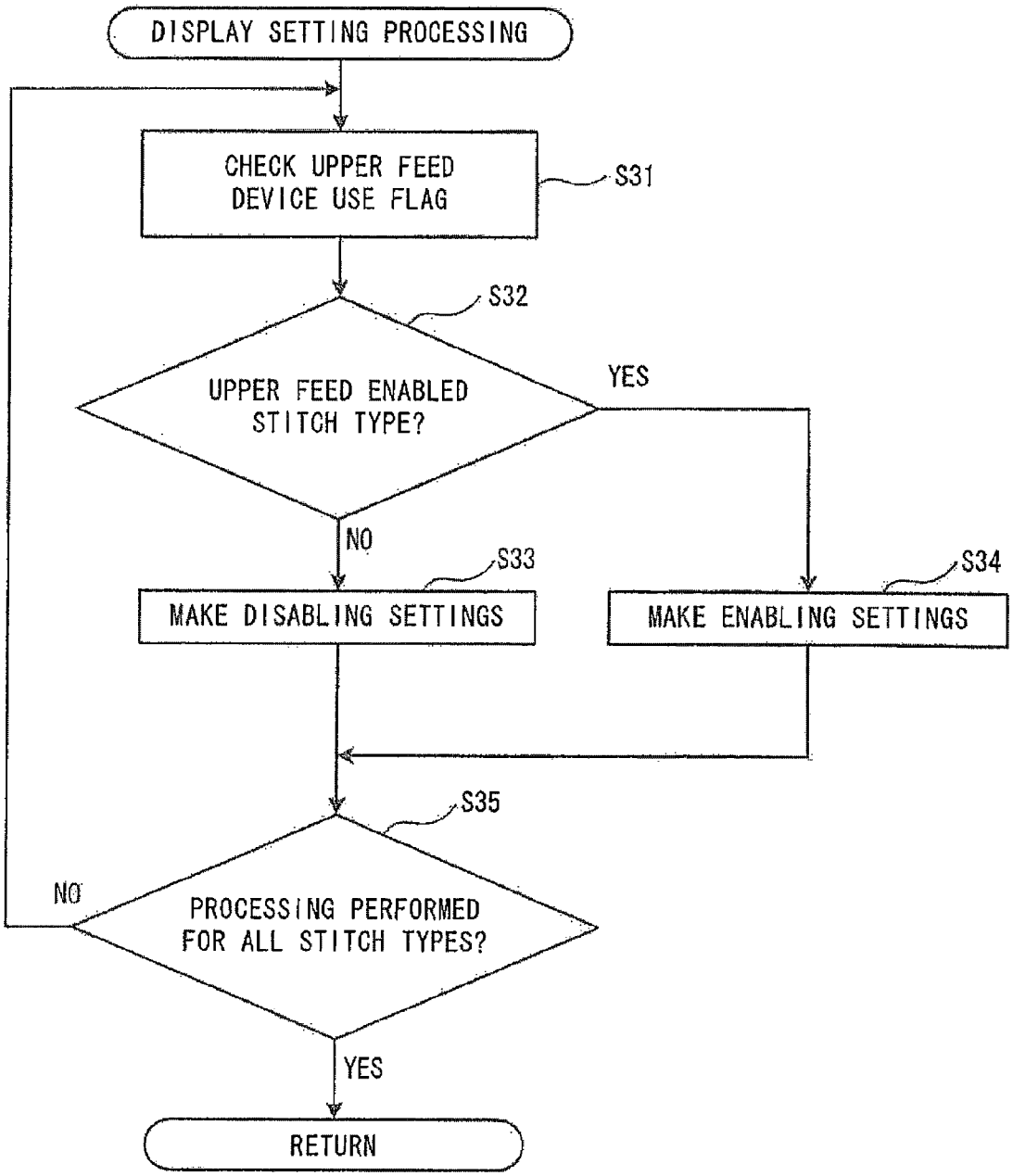
FIG. 17 is a flowchart of display setting processing.

The display setting processing will be explained with reference to FIG. 17. The display setting processing is processing that makes a setting such that an upper feed disabled stitch type is not selected. As shown in FIG. 17, first, the upper feed device use flag for one of the stitch types that are stored in the stitch type data table is checked (Step S31). Next, a determination is made as to whether the result of the check at Step S31 is that the stitch type is an upper feed enabled stitch type (Step S32). In a case where the stitch type is not an upper feed enabled stitch type (NO at Step S32), settings are made such that the stitch type selection key 103 for the stitch type for which the upper feed device use flag was checked at Step S31 cannot be used (Step S33). For example, in FIG. 18, the stitch type selection keys 103 for some of the stitch types (the stitch type numbers 1-05, 1-06, 1-07, and 1-14 among the stitch type selection keys 103) are displayed in gray (grayed out). A setting is also made such that the grayed out stitch type selection key 103 does not respond even if a panel operation is performed on the grayed out stitch type selection key 103. In the explanation that follows, the settings that are made at Step S33 are referred to as the disabling settings.

In a case where the stitch type is an upper feed enabled stitch type (YES at Step S32), settings are made such that the stitch type selection key 103 for the stitch type for which the upper feed device use flag was checked at Step S31 can be used (Step S34). At Step S34, the stitch type selection key 103 is not grayed out, unlike at Step S33. The setting for the stitch type selection key 103 is retained that makes it possible for the user to select the stitch type selection key 103 for the stitch type by performing a panel operation. In the explanation that follows, the settings that are made at Step S34 are referred to as the enabling settings.

Figure 18:
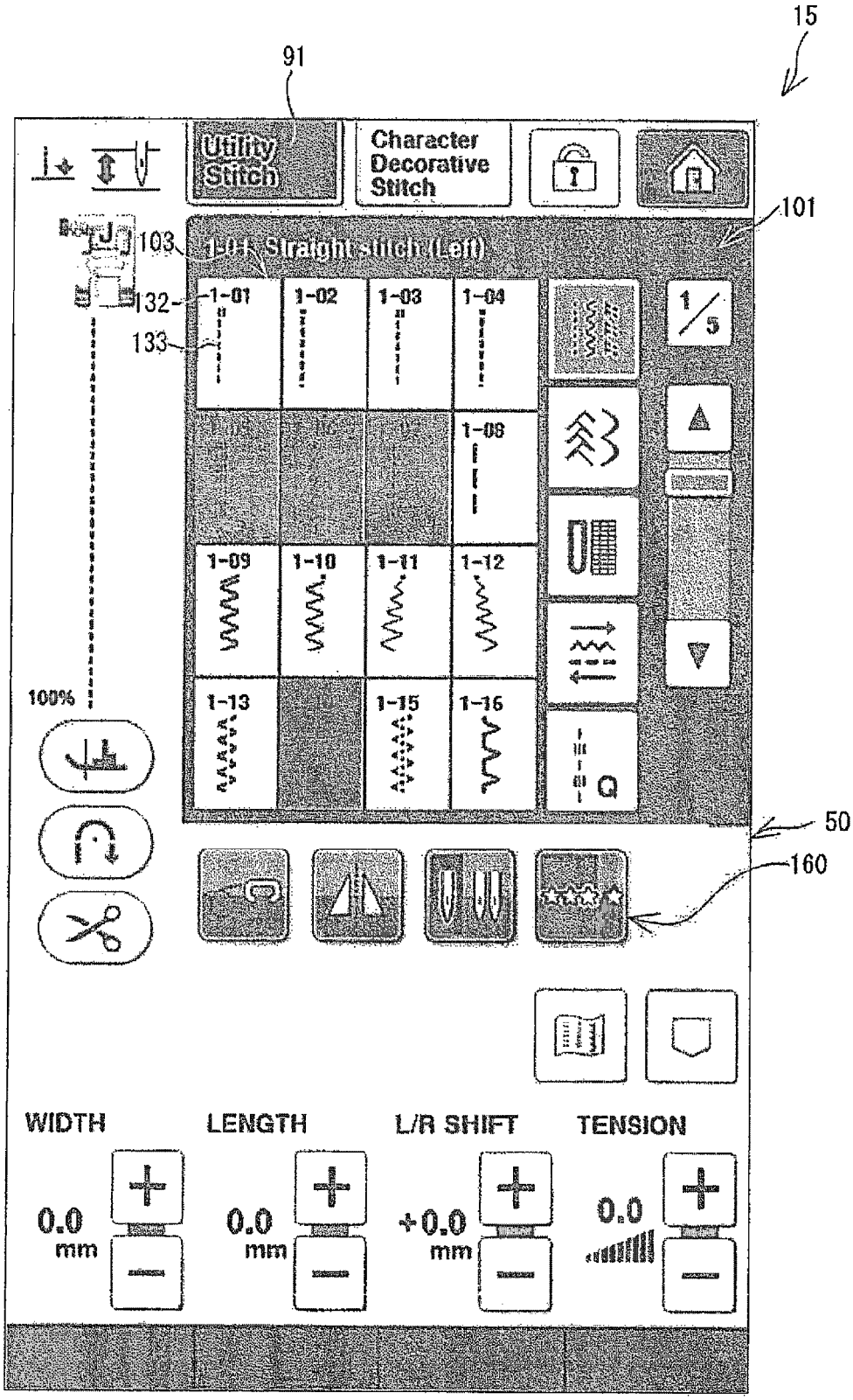
FIG. 18 is a figure that shows a state in which a screen that includes stitch selection keys for stitch types for which disabling settings have been made is displayed on the liquid crystal display.

Next, a determination is made as to whether the processing at one of Steps S33 and S34 has been performed for all of the utility stitch types that are stored in the stitch type data table (Step S35). In a case where a stitch type exists for which the processing at one of Steps S33 and S34 has not been performed (NO at Step S35), the processing returns to Step S31, and the upper feed device use flag for the next stitch type is checked. The processing at Steps S31 to S35 is thus repeated. In a case where there exists among the stitch types that are stored in the stitch type data table a stitch type for which the disabling settings have been made as a result of the processing, a screen like that shown in FIG. 18, for example, is displayed on the liquid crystal display 15. On the liquid crystal display 15 that is shown in FIG. 18, a screen is displayed on which the stitch type selection keys 103 for some of the stitch types have been grayed out. In a case where the processing at one of Steps S33 and S34 has been performed for all of the utility stitch types that are stored in the stitch type data table (YES at Step S35), the display setting processing is terminated.

The processing returns to the main processing that is shown in FIG. 16, and a determination is made as to whether a stitch type has been selected by a panel operation (Step S18). In a case where a stitch type has not been selected (NO at Step S18), the processing at Step S18 is repeated. In a case where a stitch type has been selected (YES at Step S18), a determination is made as to whether a command to start sewing has been input (Step S19). In a case where a command to start sewing has not been input (NO at Step S19), the processing at Step S19 is repeated.

In a case where the sewing start/stop switch that is included in the switch cluster 21 is operated, for example, a determination is made that a command to start sewing has been input (YES at Step S19). Then the sewing of the stitch type that was selected at Step S18 is performed (Step S20). In a case where the sewing is performed with the upper feed device 4 being used, for example, the sewing is performed while the work cloth 100 is fed by the upper feed device 4 and the feed dog 34. When the sewing is finished, the main processing is terminated.

Figure 19:
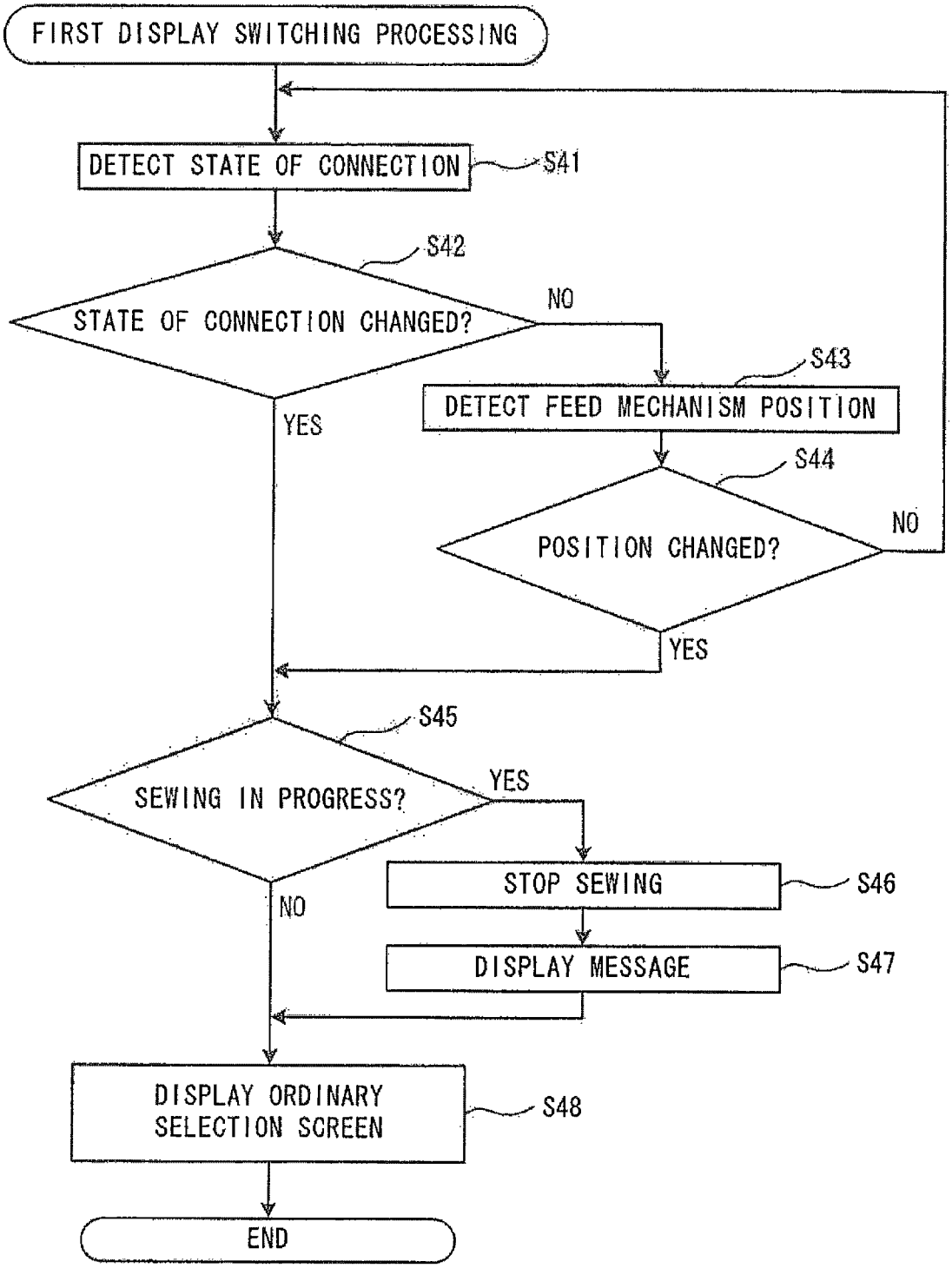
FIG. 19 is a flowchart of first display switching processing.

First display switching processing will be explained with reference to the flowchart that is shown in FIG. 19. The first display switching processing is processing that switches the displayed screen to the ordinary selection screen (refer to FIG. 14) in a case where the upper feed device 4 has changed from a state in which the upper feed device 4 can be used to a state in which the upper feed device 4 cannot be used, after the display setting processing (refer to FIG. 17) has been performed. A case where the upper feed device 4 has been changed to a state in which the upper feed device 4 cannot be used may be, for example, a case where the connector 503 of the upper feed device 4 has been removed from the connector 141 of the sewing machine 1, or a case where the position of the feed mechanism 43 has been switched from the feed position to the standby position. The CPU 61 performs the first display switching processing while also performing the processing from Step S18 onward, after the display setting processing at Step S17 of the main processing (refer to FIG. 16).

In the first display switching processing, first, the CPU 61 detects whether the motor 491 and the control portion 60 are electrically connected by the connecting portion 52 (Step S41), in the same manner as in the processing at Step S12. Next, by referencing the result of the detection at Step S41, the CPU 61 determines whether the state of the connection between the motor 491 and the control portion 60 has changed (Step S42). As explained above, the first display switching processing is processing that is performed after the screen that was created by the display setting processing has been displayed at Step S17 (refer to FIG. 16). The first display switching processing is therefore performed in a state in which the motor 491 and the control portion 60 are electrically connected. Therefore, in a case where the motor 491 and the control portion 60 are not electrically connected at Step S42, a determination is made that the state of the connection has changed. A case where the motor 491 and the control portion 60 are not electrically connected may be, for example, a case where the connector 503 of the upper feed device 4 has been removed from the connector 141 of the sewing machine 1.

In a case where the state of the connection has changed (YES at Step S42), the processing at Step S45, will be described later, is performed. In a case where the state of the connection has not changed (NO at Step S42), the position of the feed mechanism 43 (one of the feed position and the standby position) is detected (Step S43), in the same manner as in the processing at Step S14 (refer to FIG. 16). Next, by referencing the result of the detection at Step S43, the CPU 61 determines whether or not the position of the feed mechanism 43 has changed (Step S44). As explained above, the first display switching processing is processing that is performed after the screen that was created by the display setting processing has been displayed at Step S17 (refer to FIG. 16). The first display switching processing is therefore performed in a case in which the feed mechanism 43 is in the feed position. Therefore, in a case where the position of the feed mechanism 43 has changed from the feed position to the standby position at Step S44, a determination is made that the position of the feed mechanism 43 has changed.

Figure 20:
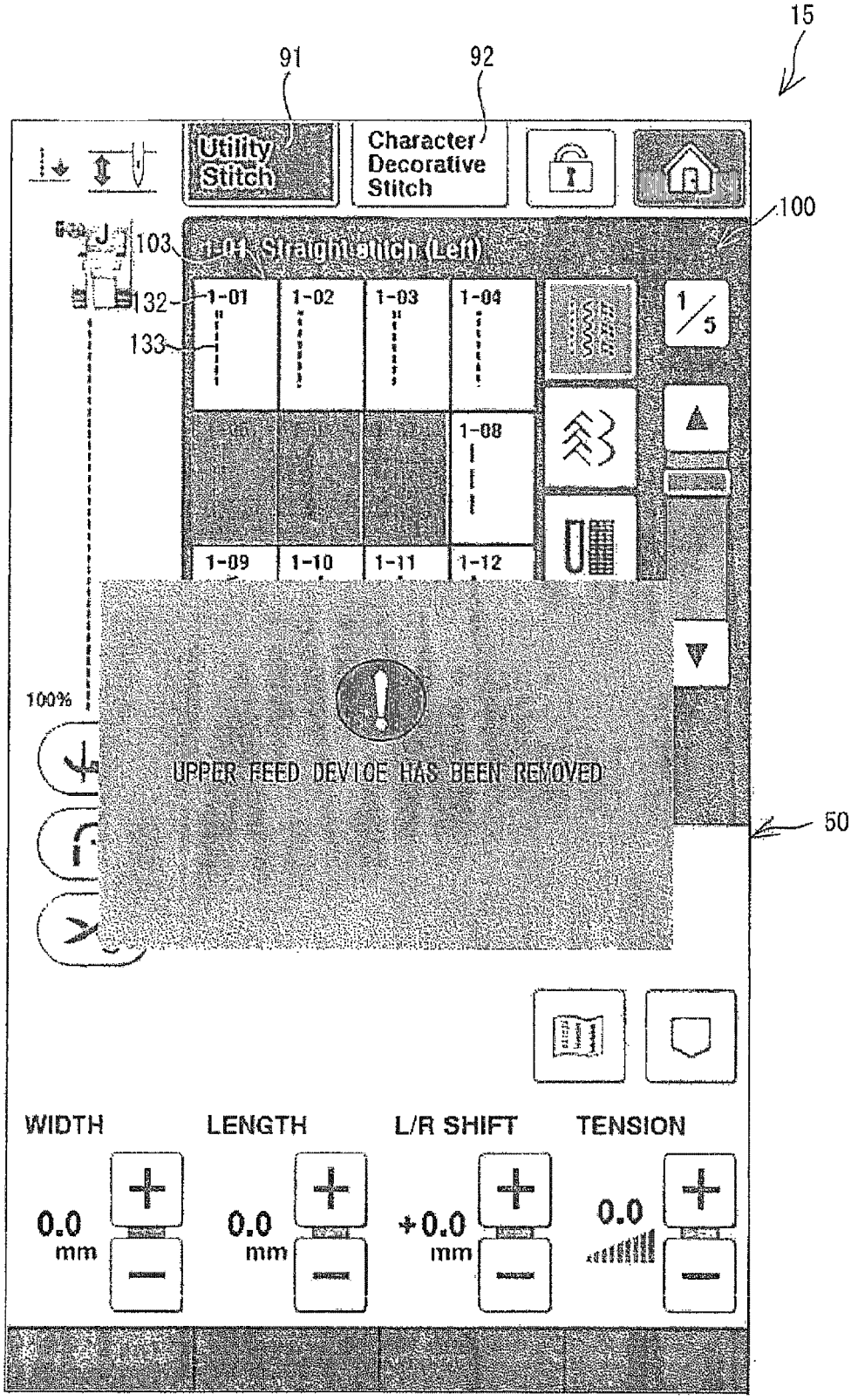
FIG. 20 is a figure that shows a state in which a message is displayed on the liquid crystal display.

In a case where the position of the feed mechanism 43 has not changed (NO at Step S44), the processing returns to Step S41. In a case where the position of the feed mechanism 43 has changed (YES at Step S44), a determination is made as to whether sewing is in progress (Step S45). For example, if the sewing at Step S20 in the main processing (refer to FIG. 16) is in the course of being performed, a determination is made that sewing is in progress. In a case where sewing is not in progress (NO at Step S45), the processing at Step S48, will be described below, is performed. In a case where sewing is in progress (YES at Step S45), the sewing is stopped (Step S46). Next, a message is displayed (Step S47). At Step S47, a message is displayed that is in accordance with the change that was determined at one of Steps S42 and S44. For example, in a case where the connector 503 of the upper feed device 4 has been removed from the connector 141 of the sewing machine 1, the message "Upper feed device has been removed" may be displayed on the liquid crystal display 15, as shown in FIG. 20 (NO at Step S42, YES at Step S45, Step S46, Step S47). After the message has been displayed for a specified time period (for example, five seconds), the message is cleared from the screen on the liquid crystal display 15.

Next, the ordinary selection screen (refer to FIG. 14), which is not created by the display setting processing, is displayed (Step S48). For example, the screen that is displayed on the liquid crystal display 15 may be switched from the state that is shown in FIG. 18 to the state that is shown in FIG. 14. Next, the first display switching processing is terminated. In this manner, in the first display switching processing, the user may be notified that the upper feed device 4 has changed from a state in which the upper feed device 4 can be used to a state in which the upper feed device 4 cannot be used. The user may also select an upper feed disabled stitch type.

Figure 21:
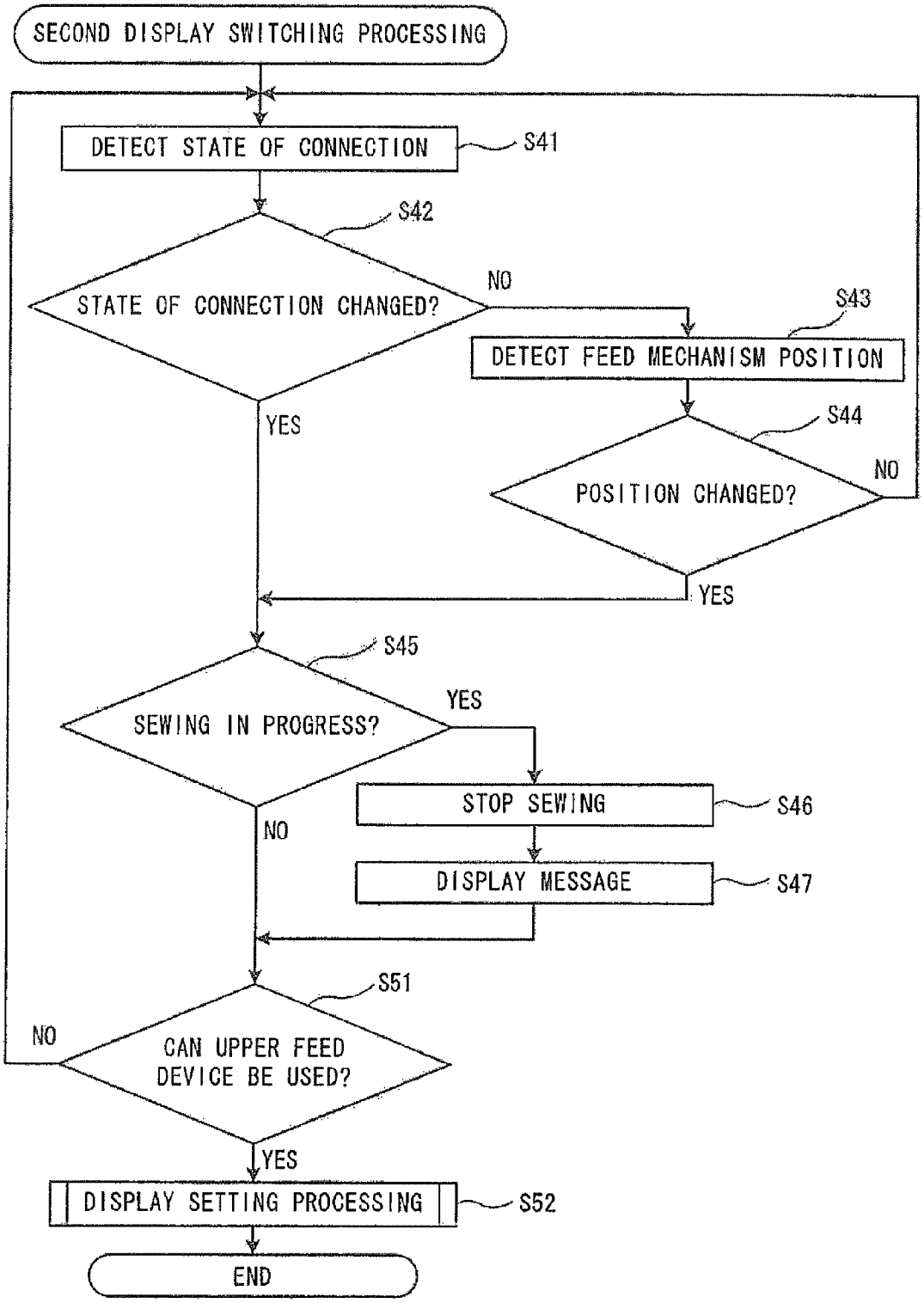
FIG. 21 is a flowchart of second display switching processing.

Second display switching processing will be explained with reference to the flowchart that is shown in FIG. 21. The second display switching processing is processing that switches to the screen (refer to FIG. 18) that is created by the display setting processing (refer to FIG. 17) in a case where the upper feed device 4 has changed from a state in which the upper feed device 4 cannot be used to a state in which the upper feed device 4 can be used, after the ordinary selection screen (refer to FIG. 14) has been displayed. A case where the upper feed device 4 has changed to a state in which the upper feed device 4 can be used may be, for example, a case where the motor 491 and the control portion 60 are electrically connected by the connecting portion 52 and the position of the feed mechanism 43 has been switched to the feed position. The CPU 61 performs the second display switching processing while performing the processing from Step S18 onward, after displaying the ordinary selection screen at Step S16 in the main processing (refer to FIG. 16). In the explanation that follows, the same reference numerals are assigned to and detailed explanations will be omitted for the processing steps that are the same as the processing steps in the first display switching processing (refer to FIG. 19).

In the second display switching processing, first, the processing at Steps S41 to S47 is performed in the same manner as in the first display switching processing. At Step S47, a message is displayed that is in accordance with the change that was determined at one of Steps S42 and S44. For example, in a case where the position of the feed mechanism 43 has been switched from the standby position to the feed position, the message "Upper feed device has been switched to feed position" may be displayed on the liquid crystal display 15.

In a case where it has been determined at Step S45 that sewing is not in progress (NO at Step S45), as well as when the message is displayed at Step S47, a determination is made as to whether or not the upper feed device 4 can be used (Step S51). At Step S51, by referencing the results of the detections at Steps S41 and S43, the CPU 61 determines that the upper feed device 4 can be used if the motor 491 and the control portion 60 are connected by the connecting portion 52 and if the feed mechanism 43 is in the feed position (Step S51).

In a case where the upper feed device 4 cannot be used (NO at Step S51), the processing returns to Step S41. In other words, the ordinary selection screen (refer to FIG. 14) continues to be displayed. In a case where the upper feed device 4 can be used (YES at Step S51), the display setting processing (refer to FIG. 17) is performed (Step S52). In this manner, the screen that is displayed on the liquid crystal display 15 is switched from the ordinary selection screen (refer to FIG. 14) to the screen that is created by the display setting processing (refer to FIG. 18). Then, the second display switching processing is terminated. In the second display switching processing, the user can thus be notified that the upper feed device 4 has changed from a state in which the upper feed device 4 cannot be used to a state in which the upper feed device 4 can be used. The user may select an upper feed enabled stitch type.

In the present embodiment, the motor 491 and the feed mechanism 43 are both provided in the one upper feed device 4. It is therefore possible to make the number of members through which the driving force of the motor 491 is transmitted to the feed mechanism 43 smaller than it would be in a case where the motor 491 and the feed mechanism 43 are provided in separate devices. That in turn makes it possible to reduce the size of the device (the upper feed device 4) for feeding the work cloth 100. The upper feed device 4 can be mounted to the presser bar 27 of the sewing machine 1. It is therefore not necessary for the user to move around to the rear of the sewing machine 1 in order to perform the work of mounting the upper feed device 4. Accordingly, the upper feed device 4 can be mounted more easily.

The force with which the front end portion of the belt 435 presses against the work cloth 100 can be adjusted by adjusting the pressure adjustment mechanism 48. That makes it possible to adjust the force with which the front end portion of the belt 435 presses against the work cloth 100 to a force that is appropriate for the thickness, the material, and the like of the work cloth 100. Accordingly, the work cloth 100 can be fed more appropriately, and the quality of the sewing can be improved.

When the switching mechanism 45 is operated, the position of the feed mechanism 43 is switched between the feed position and the standby position. Accordingly, the feed mechanism 43 can easily be moved away from the work cloth 100 simply by operating the switching mechanism 45. In a state in which the feed mechanism 43 has been moved away from the work cloth 100, the user may perform various types of work. The various types of work include, for example, moving the work cloth 100 manually, sewing while the work cloth 100 is fed only by the feed dog 34, and the like. In other words, there is no need to remove the upper feed device 4 itself from the presser bar 27, even if the form of the sewing work changes. Accordingly, sewing can be performed more efficiently than it can in a case where it is necessary to remove the upper feed device 4, even when the work cloth 100 is fed only by the feed dog 34. The position of the feed mechanism 43 can be switched easily to the feed position. Therefore, sewing for which the upper feed device 4 is used can be started smoothly.

In a case where the presser bar 27 is moved upward, the upper feed device 4 is moved upward, and the presser foot 51 is moved away from the work cloth 100. In a case where the presser bar 27 is moved downward, the upper feed device 4 is moved downward, and the presser foot 51 may press the work cloth 100 downward. Thus the upper feed device 4 is moved up and down in conjunction with the upward and downward movements of the presser bar 27. Therefore, various types of work can be performed when the presser bar 27 is in a raised state without removing the upper feed device 4. For example, when the presser bar 27 is in a raised state, the user may set and remove the work cloth 100 manually. The user may rotate and move the work cloth 100 in order to change the direction of the sewing. The user can move the presser bar 27 from a raised state to a lowered state and perform sewing smoothly. The operating efficiency of the sewing may be improved accordingly.

The belt 435 may be replaced by another belt. Therefore, the belt 435 may be replaced by a belt that has a coefficient of friction that is appropriate for the thickness, the material, and the like of the work cloth 100, for example. In that way, the work cloth 100 may be fed appropriately. The quality of the sewing may be improved accordingly. In a case where the upper feed device 4 is used for a long time, the belt 435 may become worn. In those cases, the belt 435 may be replaced by a new belt. The work cloth 100 may thereby be fed appropriately. The quality of the sewing may therefore be maintained well.

In the main processing (refer to FIG. 16), the CPU 61 detects whether the motor 491 and the control portion 60 are electrically connected by the connecting portion 52 (Step S12). In a case where the result of the detection at Step S12 is that the motor 491 and the control portion 60 are not connected (NO at Step S13), the ordinary selection screen (refer to FIG. 14) is displayed (Step S16). A case where the screen that is created by the display setting processing (refer to FIG. 18) is displayed (Steps S31 to S35) is a case where the motor 491 and the control portion 60 are connected (YES at Step S13). In other words, by displaying the screen that is created by the display setting processing, the CPU 61 informs the user that the motor 491 and the control portion 60 are electrically connected. Therefore, by checking the liquid crystal display 15, the user may easily determine the state of the connection between the motor 491 and the control portion 60, that is, the state of the connection between the upper feed device 4 and the sewing machine 1. The burden of the work of checking the state of the connection may be lightened accordingly. Therefore, the efficiency of the sewing work may be improved.

In the main processing, the CPU 61 detects whether the position of the feed mechanism 43 is the feed position or the standby position (Step S14). In a case where the result of the detection at Step S14 is that the feed mechanism 43 is not in the feed position (NO at Step S15), the ordinary selection screen (refer to FIG. 14) is displayed. In a case where the feed mechanism 43 is in the feed position (YES at Step S15), the screen that is created by the display setting processing (refer to FIG. 18) is displayed (Steps S31 to S35). In other words, by displaying the screen that is created by the display setting processing, the CPU 61 can notify the user that the feed mechanism 43 is in the feed position. Therefore, by checking the liquid crystal display 15, the user may easily determine the position of the feed mechanism 43. The burden of the work of checking the state of the position of the feed mechanism 43 may be lightened accordingly. Therefore, the efficiency of the sewing work may be improved.

In the first display switching processing (refer to FIG. 19) and the second display switching processing (refer to FIG. 21), in a case where it is determined that the state of the connection between the motor 491 and the control portion 60 has changed (YES at Step S42), the sewing is stopped (Step S46). Thus, in a case where the state of the connection between the motor 491 and the control portion 60 has changed for some reason while the sewing is in progress, it is possible to stop the sewing automatically. For example, the connecting portion 52 may be disconnected from the sewing machine 1 for some reason while sewing is being performed with the upper feed device 4 being used. In this sort of case, the sewing machine 1 stops at the same time that the upper feed device 4 stops. The user may therefore perform the sewing work safely. Moreover, the stitches that are formed in the work cloth 100 may not be affected by the change in the state of the connection. It is therefore possible to prevent a drop in the quality of the sewing.

In the first display switching processing (refer to FIG. 19) and the second display switching processing (refer to FIG. 21), in a case where it is determined that the position of the feed mechanism 43 has changed (YES at Step S44), the sewing is stopped (Step S46). Thus, in a case where the position of the feed mechanism 43 has changed while the sewing is in progress, it is possible to stop the sewing operation automatically. For example, the feed mechanism 43 may be switched to the feed position for some reason while sewing is being performed with the work cloth 100 being fed by the feed dog 34 alone. In this case, the belt 435 may come into contact with the work cloth 100. The sewing machine 1 stops immediately, so the user may perform the sewing work safely. Moreover, the stitches that are formed in the work cloth 100 may not be affected by the change in the position of the feed mechanism 43. It is therefore possible to prevent a drop in the quality of the sewing.

In the display setting processing (refer to FIG. 17) in the main processing (refer to FIG. 16) and the second display switching processing (refer to FIG. 21), in a case where the stitch type is not an upper feed enabled stitch type (NO at Step S32), the disabling settings are made (Step S33). In a case where the stitch type is an upper feed enabled stitch type (YES at Step S32), the enabling settings are made (Step S34). The stitch type selection keys 103 for the stitch types for which the disabling settings have been made are grayed out. In other words, by making one of the disabling settings and the enabling settings, the CPU 61 can notify the user whether the stitch type is an upper feed enabled stitch type. Therefore, by looking at the screen that is displayed on the liquid crystal display 15, the user may easily determine whether any one of the stitch types is an upper feed enabled stitch type. The user may determine in a short time whether the upper feed device 4 is to be used and may perform the sewing accordingly. The efficiency of the sewing work may therefore be improved.

In the present embodiment, the work cloth 100 may be fed by being clamped between the upper feed device 4 and the feed dog 34. The work cloth 100 may be a work cloth that is difficult to sew (difficult to feed), such as a vinyl cloth, a synthetic leather, or the like, for example, or the work cloth 100 may be a material on which sewing slippage tends to occur, such as a quilted material in which cotton is sandwiched between two layers of cloth, a velvet with a raised nap surface, or the like. In the present embodiment, the work cloth 100 may be fed reliably even in these sorts of cases. The quality of the sewing may thereby be improved. As shown in FIG. 6 and the like, ordinary sewing may be performed on two of the work cloths 100, one on top of the other. In this sort of case, the upper and lower work cloths 100 may be fed reliably without any slippage. The quality of the sewing may therefore be improved even more.

The present disclosure is not limited to the embodiment that is described above, and various types of modifications can be made. For example, in the embodiment that is described above, the belt 435 can be replaced. However, the belt 435 cannot be replaced. The position of the feed mechanism 43 can be switched between the feed position and the standby position. However, the position of the feed mechanism 43 cannot be switched between the feed position and the standby position.

In the embodiment that is described above, the CPU 61 can notify the user that the feed mechanism 43 is in the feed position by displaying the screen that is created by the display setting processing (Step S17). However, the user may be notified of the position of the feed mechanism 43 by a different method. For example, the CPU 61 may display on the liquid crystal display 15 a mark or a message that indicates that the feed mechanism 43 is in the feed position. The CPU 61 may display on the liquid crystal display 15 a mark or a message that indicates that the feed mechanism 43 is in the standby position. The sewing machine 1 may be provided with a light-emitting diode (LED). Then, when the feed mechanism 43 is in the standby position, the CPU 61 may keep the LED lighted continuously. The CPU 61 may cause the LED to flash when the feed mechanism 43 is in the feed position.

In the embodiment that is described above, the CPU 61 can notify the user that the motor 491 and the control portion 60 are electrically connected by displaying the screen that is created by the display setting processing (Step S17). However, the user may be notified of the state of the connection between the motor 491 and the control portion 60 by a different method. For example, in the same manner as when the CPU 61 notifies the user of the position of the feed mechanism 43, the CPU 61 may inform the user of the state of the connection between the motor 491 and the control portion 60 by displaying a mark or a message or by turning the LED on.

In the embodiment that is described above, the CPU 61 causes the stitch type selection key 103 to be grayed out in a case where the CPU 61 makes the disabling settings (Step S33). The CPU 61 also makes a setting such that the stitch type selection key 103 does not respond even if a panel operation is made on the stitch type selection key 103. However, the disabling settings may be made by a different method. For example, the CPU 61 may clear from the display the stitch type selection key 103 for the upper feed disabled stitch type, and the CPU 61 may display only the stitch type selection key 103 for the upper feed enabled stitch type. The CPU 61 may make only the setting that prevents the stitch type selection key 103 from responding even if a panel operation is made on the stitch type selection key 103, without causing the stitch type selection key 103 to be grayed out.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An upper feed device comprising:

a housing;

a mounting portion including a part provided in the housing and a part protruding from the housing, the mounting portion being configured to mount the upper feed device to a presser bar of a sewing machine with the mounting portion removably fixed to the presser bar, and the mounting portion being configured such that only the presser bar supports the upper feed device via the mounting portion;

a feed mechanism including a part provided in the housing and a part protruding from the housing, the feed mechanism being configured to feed a work cloth in a first direction, the feed mechanism including a pressing portion configured to press the work cloth, and the pressing portion being configured to feed the work cloth while pressing the work cloth;

a motor provided in the housing, the motor being configured to drive the feed mechanism;

a connecting portion including a lead wire and a connector, the lead wire extending to an outside of the housing, and the connecting portion being configured to electrically connect the motor to a control portion of the sewing machine; and a presser foot:

provided, with respect to the housing in the first direction, on a same side of the part of the mounting portion protruding from the housing; and comprising a first through-hole and a second through-hole, the first through-hole being farther from the housing than the second-through hole in the first direction, the first through-hole being configured such that a sewing needle attached to a needle bar of the sewing machine passes through the first through-hole when the upper feed device is mounted to the presser bar, the needle bar being configured to move in a second direction different from the first direction, the second through-hole penetrating in the second direction, the second through-hole extending to an edge of the presser foot on a side farther from the first through-hole in the first direction, the second through-hole being configured such that the pressing portion is disposed inside the second through-hole, a part of the presser foot being provided on each side of the second through-hole in a third direction that is both orthogonal to the first direction and different from the second direction.

2. The upper feed device according to claim 1, wherein the motor is configured to be controlled by the control portion of the sewing machine via the connecting portion, when the connecting portion electrically connects the motor to the control portion of the sewing machine.

3. The upper feed device according to claim 1, wherein the control portion is a processor, and the motor is configured to be controlled by the processor via the connecting portion, when the connecting portion electrically connects the motor to the processor.

4. The upper feed device according to claim 1, further comprising:

an adjusting portion configured to adjust pressing force to be applied to the work cloth by the pressing portion.

5. The upper feed device according to claim 1, further comprising:

a switching mechanism configured to switch a position of the feed mechanism between a first position and a second position, wherein the pressing portion is configured to press and the feed mechanism is configured to feed the work cloth at the first position, and the feed mechanism is configured to be separated from the work cloth at the second position being a position that is different from the first position in relation to the mounting portion.

6. The upper feed device according to claim 1, wherein the feed mechanism further includes:

a first pulley configured to be rotated by rotational force of the motor; and a second pulley that is separated from the first pulley and that is configured to be rotated in conjunction with a rotation of the first pulley; and the pressing portion is a portion of a belt that is provided around the first pulley and the second pulley, the portion of the belt being configured to press the work cloth below the second pulley.

7. The upper feed device according to claim 6, wherein the belt is configured to be mountable on and removable from the first pulley and the second pulley.

8. A sewing machine comprising:

a presser bar;

a needle bar configured such that a sewing needle is attached to the needle bar, the needle bar being configured to move in a first direction;

a control portion; and an upper feed device that includes:

a mounting portion including a part provided in the housing and a part protruding from the housing, the mounting portion being configured to mount the upper feed device to the presser bar with the mounting portion removably fixed to the presser bar, and the mounting portion being configured such that only the presser bar supports the upper feed device via the mounting portion;

a feed mechanism including a part provided in the housing and a part protruding from the housing, the feed mechanism being configured to feed a work cloth in a second direction different from the first direction, the feed mechanism including a pressing portion configured to press the work cloth, and the pressing portion being configured to feed the work cloth while pressing the work cloth;

a motor provided in the housing, the motor being configured to drive the feed mechanism; and a connecting portion including a lead wire and a connector, the lead wire extending to an outside of the housing, and the connecting portion configured to electrically connect the motor to the control portion; and a presser foot:

provided, with respect to the housing in the second direction, on a same side of the part of the mounting portion protruding from the housing; and comprising a first through-hole and a second through-hole, the first through-hole being farther from the housing than the second-through hole in the second direction, the first through-hole being configured such that the sewing needle attached to the needle bar passes through the first through-hole when the upper feed device is mounted to the presser bar, the second through-hole penetrating in the first direction, the second through-hole extending to an edge of the presser foot on a side farther from the first through-hole in the second direction, the second through-hole being configured such that the pressing portion is disposed inside the second through-hole, a part of the presser foot being provided on each side of the second through-hole in a third direction that is both orthogonal to the second direction and different from the first direction.

9. The sewing machine according to claim 8, wherein the motor is configured to be controlled by the control portion via the connecting portion, when the connecting portion electrically connects the motor to the control portion.

10. The sewing machine according to claim 8, wherein the control portion is a processor, and the motor is configured to be controlled by the processor via the connecting portion, when the connecting portion electrically connects the motor to the processor.

11. The sewing machine according to claim 8, wherein the upper feed device further includes:

an adjusting portion configured to adjust pressing force to be applied to the work cloth by the pressing portion.

12. The sewing machine according to claim 8, wherein the upper feed device further includes:

a switching mechanism that is configured to switch a position of the feed mechanism between a first position and a second position, wherein the pressing portion is configured to press and the feed mechanism is configured to feed the work cloth at the first position, and the feed mechanism is configured to be separated from the work cloth at the second position being a position that is different from the first position in relation to the mounting portion.

13. The sewing machine according to claim 12, further comprising:

a non-transitory memory configured to store computer-readable instructions that instruct the control portion to execute steps comprising:

detecting whether the feed mechanism is in the first position or in the second position; and providing notification of a state that corresponds to a result of the detecting whether the feed mechanism is in the first position or in the second position.

14. The sewing machine according to claim 13, wherein the computer-readable instructions further instruct the control portion to execute a step comprising:

stopping a sewing operation of the sewing machine in response to detecting one of a change in the position of the feed mechanism from the first position to the second position and a change in the position of the feed mechanism from the second position to the first position.

15. The sewing machine according to claim 8, wherein the feed mechanism further includes:

a first pulley configured to be rotated by rotational force of the motor; and a second pulley that is separated from the first pulley and that is configured to be rotated in conjunction with a rotation of the first pulley; and the pressing portion is a portion of a belt that is provided around the first pulley and the second pulley, the portion of the belt being configured to press the work cloth below the second pulley.

16. The sewing machine according to claim 15, wherein the belt is configured to be mountable on and removable from the first pulley and the second pulley.

17. The sewing machine according to claim 8, further comprising:

a non-transitory memory configured to store computer-readable instructions that instruct the control portion to execute steps comprising:

detecting whether the motor and the control portion are electrically connected; and providing notification of a state that corresponds to a result of the detecting whether the motor and the control portion are electrically connected.

18. The sewing machine according to claim 17, wherein the computer-readable instructions further instruct the control portion to execute a step comprising:

stopping a sewing operation of the sewing machine in response to detecting one of a change from a first state to a second state and a change from the second state to the first state, the first state being a state in which the motor and the control portion are electrically connected, and the second state being a state in which the motor and the control portion are not electrically connected.

19. The sewing machine according to claim 8, further comprising:

a non-transitory storage portion configured to store a plurality of stitch types; and a non-transitory memory configured to store computer-readable instructions that instruct the control portion to execute steps comprising:

determining whether at least one of the plurality of the stitch types stored in the storage portion is an upper feed enabled stitch type, which is a stitch type that can be sewn while the upper feed device is used; and providing notification of a result of the determining whether the at least one of the plurality of the stitch types is the upper feed enabled stitch type.

* * * * *